US010994556B2

(12) United States Patent
Morita

(10) Patent No.: US 10,994,556 B2
(45) Date of Patent: May 4, 2021

(54) IMAGE FORMING APPARATUS, METHOD, AND COMPUTER-READABLE MEDIUM FOR SETTING IMAGE FORMING CONDITIONS IN DUPLEX PRINTING

(71) Applicant: Brother Kogyo Kabushiki Kaisha, Nagoya (JP)

(72) Inventor: Tetsuya Morita, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 344 days.

(21) Appl. No.: 16/207,277

(22) Filed: Dec. 3, 2018

(65) Prior Publication Data

US 2019/0193423 A1 Jun. 27, 2019

(30) Foreign Application Priority Data

Dec. 27, 2017 (JP) ..... JP2017-252346

(51) Int. Cl.

| | |
|---|---|
| ***B41J 3/60*** | (2006.01) |
| ***G03G 15/00*** | (2006.01) |
| ***G03G 15/23*** | (2006.01) |
| ***B41J 11/00*** | (2006.01) |

(52) U.S. Cl.

CPC ..... *B41J 3/60* (2013.01); *B41J 11/009* (2013.01); *G03G 15/234* (2013.01); *G03G 15/5029* (2013.01); *G03G 15/602* (2013.01); *G03G 15/605* (2013.01); *G03G 15/6591* (2013.01); *G03G 2215/00742* (2013.01)

(58) Field of Classification Search

CPC ..... B41J 3/60; B41J 11/009; G03G 15/234; G03G 15/5029; G03G 15/602; G03G 15/605; G03G 15/6591; G03G 2215/00742

See application file for complete search history.

(56) References Cited

U.S. PATENT DOCUMENTS

2010/0165398 A1* 7/2010 Watanabe ..... H04N 1/233 358/1.15
2010/0172663 A1* 7/2010 Nakai ..... G03G 15/6591 399/45
2015/0160594 A1* 6/2015 Shibuya ..... G03G 15/2039 399/69

(Continued)

FOREIGN PATENT DOCUMENTS

JP 2016-055933 A 4/2016

*Primary Examiner* — David H Banh

(74) *Attorney, Agent, or Firm* — Burr & Brown, PLLC

(57) ABSTRACT

An image forming apparatus includes a second conveyance guide diverging from a first conveyance guide at a bifurcation and joining the first conveyance guide at a junction, the bifurcation being downstream of a first position of an image former in a conveyance direction, the junction being upstream of the first position in the conveyance direction, first and second sensors disposed in second and third positions between the junction and the first position along the first conveyance guide, respectively, and a controller that, when a sheet passes through the second and third positions for a second time, detects a surface characteristic of a side of the sheet by the first sensor and determines an image forming condition for the side based on the surface characteristic of the side and a basis weight detected by the second sensor when the sheet passed through the second and third positions for a first time.

13 Claims, 11 Drawing Sheets

(56) References Cited

U.S. PATENT DOCUMENTS

| | | | | |
|---|---|---|---|---|
| 2016/0152052 | A1* | 6/2016 | Namiki | G01N 29/11 73/602 |
| 2016/0371573 | A1* | 12/2016 | Fujioka | G06F 3/0482 |
| 2017/0070637 | A1* | 3/2017 | Dandoko | H04N 1/00058 |
| 2017/0171432 | A1* | 6/2017 | Qiao | G06K 15/1836 |
| 2018/0074428 | A1* | 3/2018 | Furukawa | G03G 15/0283 |

* cited by examiner

IMAGE FORMING APPARATUS, METHOD, AND COMPUTER-READABLE MEDIUM FOR SETTING IMAGE FORMING CONDITIONS IN DUPLEX PRINTING

CROSS-REFERENCE TO RELATED APPLICATION

This application claims priority under 35 U.S.C. § 119 from Japanese Patent Application No. 2017-252346 filed on Dec. 27, 2017. The entire subject matter of the application is incorporated herein by reference.

BACKGROUND

Technical Field

Aspects of the present disclosure are related to an image forming apparatus, a method, and a non-transitory computer-readable medium for setting image forming conditions in duplex printing.

Related Art

Heretofore, an image forming apparatus has been known that includes a sensor for detecting surface characteristics of a recording material (e.g., a printing sheet) and a sensor for detecting a basis weight of the recording material. The known apparatus may further include a controller configured to identify a type of the recording material based on information output from the two sensors and adjust image forming conditions (e.g., transfer conditions and fixing conditions), thereby controlling the apparatus under the image forming conditions suitable for each type of recording material. It is noted that, for instance, the transfer conditions may include a transfer voltage and a conveyance speed for the recording material in an image transferring operation to transfer a developer image onto the recording material. Further, for instance, the fixing conditions may include a fixing temperature and a conveyance speed for the recording material in an image fixing operation to fix the developer image transferred on the recording material.

SUMMARY

The known apparatus may form an image on a recording material after detecting a basis weight of the recording material and surface characteristics of a specific side of the recording material by the two sensors and adjusting the image forming conditions. Further, in duplex image formation to form an image on each side of a recoding medium, the apparatus may form an image on a first side of the recording material after detecting a basis weight and surface characteristics for the first side and adjusting the image forming conditions for the first side, and then may form an image on a second side of the recording material after detecting a basis weight and surface characteristics for the second side and adjusting the image forming conditions for the second side. Accordingly, throughput for image formation may be improved by shortening a period of time required for operations such as detecting the basis weight and the surface characteristics for the second side and adjusting the image forming conditions for the second side.

Aspects of the present disclosure are advantageous to provide one or more improved techniques, for an image forming apparatus, which make it possible to identify a type of a recording material and improve throughput for duplex image formation for the recording material.

According to aspects of the present disclosure, an image forming apparatus is provided, which has a duplex printing function to perform image formation on both sides of a sheet by inverting the sheet, and includes a first conveyance guide configured to guide the sheet therealong, an image former disposed in a first position along the first conveyance guide, the image former being configured to perform image formation on each side of the sheet being conveyed along the first conveyance guide, under a specific image forming condition for each side of the sheet, a second conveyance guide diverging from the first conveyance guide at a bifurcation and joining the first conveyance guide at a junction, the bifurcation being positioned downstream of the first position in the conveyance direction on the first conveyance guide, the junction being positioned upstream of the first position in the conveyance direction on the first conveyance guide, a first sensor disposed in a second position between the junction and the first position along the first conveyance guide, the first sensor being configured to detect surface characteristics of the sheet, a second sensor disposed in a third position between the junction and the first position along the first conveyance guide, the second sensor being configured to detect a basis weight of the sheet, and a controller. The controller is configured to judge whether to perform image formation on a single side or both the sides of the sheet, and when judging to perform image formation on both the sides of the sheet, perform a duplex printing process. The duplex printing process includes when the sheet passes through the second position and the third position while being conveyed for image formation on a first side of the sheet, detecting, by the first sensor, a surface characteristic of the first side of the sheet, and detecting the basis weight of the sheet by the second sensor, determining an image forming condition for the first side of the sheet, based on the surface characteristic of the first side and the basis weight of the sheet, controlling the image former to perform image formation on the first side of the sheet under the image forming condition determined for the first side, when the sheet, after inverted, again passes through the second position and the third position while being conveyed for image formation on a second side of the sheet, detecting, by the first sensor, a surface characteristic of the second side of the sheet, the second side being an opposite surface of the first side, determining an image forming condition for the second side of the sheet, based on the surface characteristic of the second side and the basis weight detected by the second sensor when the sheet passed through the second position and the third position for image formation on the first side of the sheet, and controlling the image former to perform image formation on the second side of the sheet under the image forming condition determined for the second side.

According to aspects of the present disclosure, further provided is a method implementable on a processor coupled with an image forming apparatus. The image forming apparatus has a duplex printing function to perform image formation on both sides of a sheet by inverting the sheet, and includes a first conveyance guide configured to guide the sheet therealong, an image former disposed in a first position along the first conveyance guide, the image former being configured to perform image formation on each side of the sheet being conveyed along the first conveyance guide, under a specific image forming condition for each side of the sheet, a second conveyance guide diverging from the first conveyance guide at a bifurcation and joining the first conveyance guide at a junction, the bifurcation being positioned downstream of the first position in the conveyance direction on the first conveyance guide, the junction being positioned upstream of the first position in the conveyance direction on the first conveyance guide, a first sensor disposed in a second position between the junction and the first position along the first conveyance guide, the first sensor being configured to detect surface characteristics of the sheet, and a second sensor disposed in a third position between the junction and the first position along the first conveyance guide, the second sensor being configured to detect a basis weight of the sheet. The method includes judging whether to perform image formation on a single side or both the sides of the sheet, and when judging to perform image formation on both the sides of the sheet, performing a duplex printing process. The duplex printing process includes when the sheet passes through the second position and the third position while being conveyed for image formation on a first side of the sheet, detecting, by the first sensor, a surface characteristic of the first side of the sheet, and detecting the basis weight of the sheet by the second sensor, determining an image forming condition for the first side of the sheet, based on the surface characteristic of the first side and the basis weight of the sheet, controlling the image former to perform image formation on the first side of the sheet under the image forming condition determined for the first side, when the sheet, after inverted, again passes through the second position and the third position while being conveyed for image formation on a second side of the sheet, detecting, by the first sensor, a surface characteristic of the second side of the sheet, the second side being an opposite surface of the first side, determining an image forming condition for the second side of the sheet, based on the surface characteristic of the second side and the basis weight detected by the second sensor when the sheet passed through the second position and the third position for image formation on the first side of the sheet, and controlling the image former to perform image formation on the second side of the sheet under the image forming condition determined for the second side.

According to aspects of the present disclosure, further provided is a non-transitory computer-readable medium storing computer-readable instructions that are executable by a processor coupled with an image forming apparatus. The image forming apparatus has a duplex printing function to perform image formation on both sides of a sheet by inverting the sheet, and includes a first conveyance guide configured to guide the sheet therealong, an image former disposed in a first position along the first conveyance guide, the image former being configured to perform image formation on each side of the sheet being conveyed along the first conveyance guide, under a specific image forming condition for each side of the sheet, a second conveyance guide diverging from the first conveyance guide at a bifurcation and joining the first conveyance guide at a junction, the bifurcation being positioned downstream of the first position in the conveyance direction on the first conveyance guide, the junction being positioned upstream of the first position in the conveyance direction on the first conveyance guide, a first sensor disposed in a second position between the junction and the first position along the first conveyance guide, the first sensor being configured to detect surface characteristics of the sheet, and a second sensor disposed in a third position between the junction and the first position along the first conveyance guide, the second sensor being configured to detect a basis weight of the sheet. The instructions are configured to, when executed by the processor, cause the processor to judge whether to perform image formation on a single side or both the sides of the sheet, and when judging to perform image formation on both the sides of the sheet, perform a duplex printing process. The duplex printing process includes when the sheet passes through the second position and the third position while being conveyed for image formation on a first side of the sheet, detecting, by the first sensor, a surface characteristic of the first side of the sheet, and detecting the basis weight of the sheet by the second sensor, determining an image forming condition for the first side of the sheet, based on the surface characteristic of the first side and the basis weight of the sheet, controlling the image former to perform image formation on the first side of the sheet under the image forming condition determined for the first side, when the sheet, after inverted, again passes through the second position and the third position while being conveyed for image formation on a second side of the sheet, detecting, by the first sensor, a surface characteristic of the second side of the sheet, the second side being an opposite surface of the first side, determining an image forming condition for the second side of the sheet, based on the surface characteristic of the second side and the basis weight detected by the second sensor when the sheet passed through the second position and the third position for image formation on the first side of the sheet, and controlling the image former to perform image formation on the second side of the sheet under the image forming condition determined for the second side.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

First Illustrative Embodiment

Hereinafter, a first illustrative embodiment according to aspects of the present disclosure will be described with reference to the accompanying drawings.

<Mechanical Configuration>

Figure 1:
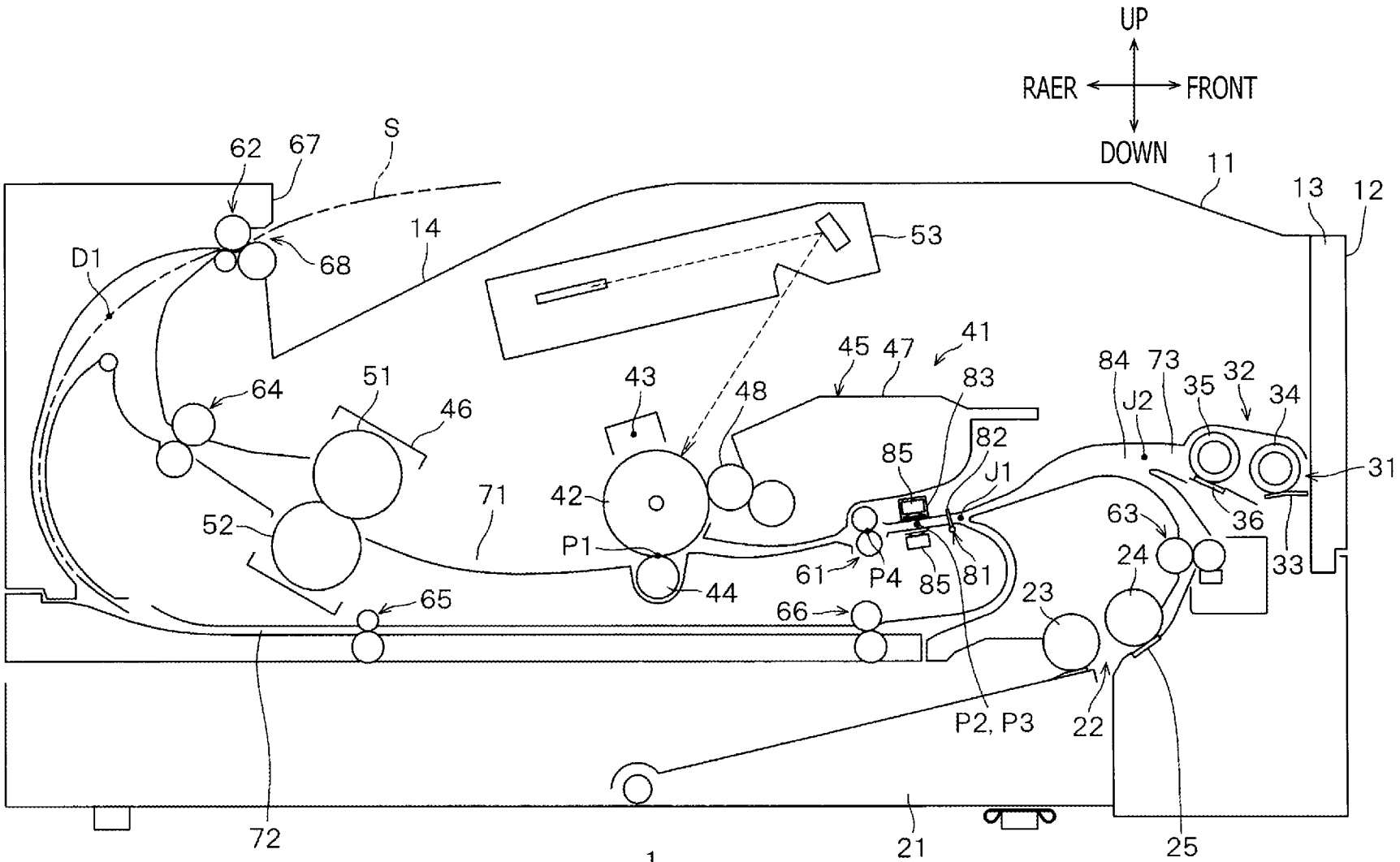
FIG. 1 is a cross-sectional side view schematically showing a configuration of a laser printer in a first illustrative embodiment according to one or more aspects of the present disclosure.

FIG. 1 schematically shows a cross-sectional side view of a monochrome laser printer 1. The laser printer 1 includes a housing 11 formed substantially in a rectangular parallelepiped shape.

A multi-purpose tray 13 is attached to a side face 12 of the housing 11, to be openable and closable relative to the side face 12. The multi-purpose tray 13 is configured to, when opened and closed, move between a usable position and an unusable position. In the usable position, the multi-purpose tray 13 is open relative to the side face 12 of the housing 11 so as to horizontally extend outward from the side face 12. In the unusable position, the multi-purpose tray 13 is closed relative to the side face 12 of the housing 11 so as to vertically extend along the side face 12. The multi-purpose tray 13 is further configured to, when in the usable position, support a stack of recording materials S (e.g., printing sheets) placed thereon.

In the following description, a "front side" of the laser printer 1 will be defined as a side where the side face 12 is disposed. A "rear side" of the laser printer 1 will be defined as an opposite side of the side face 12 (i.e., the "front side") across the housing 11. Accordingly, hereinafter, the side face 12 may be referred to as a "front face 12." On the basis of the laser printer 1 viewed from the "front side," an "upside," a "downside," a "left side," and a "right side" of the laser printer 1 will be defined. In FIG. 1, a vertical direction and a front-to-rear direction according to the aforementioned definitions are indicated by respective arrows.

On an upper face of the housing 11, a discharge tray 14 is formed as a recessed section with a bottom surface inclined to be lower towards the rear. The discharge tray 14 is configured to support a stack of recording materials S discharged thereon.

A feed tray 21 is disposed at a bottom section inside the housing 11. The feed tray 21 is configured to be inserted into and pulled out of the housing 11. In other words, the feed tray 21 is attached in an attachment position at the bottom section inside the housing 11, in a manner drawable frontwards from the attachment position.

A first feeding mechanism 22 is disposed above a front end portion of the feed tray 21. The first feeding mechanism 22 includes a first pickup roller 23, a first separation roller 24, and a first separation pad 25.

The first pickup roller 23 is rotatable around an axis extending along the left-to-right direction. When the feed tray 21 is attached in the attachment position inside the housing 11, a circumferential surface of the first pickup roller 23 is in contact with an upper surface of a front end portion of a top one of recording materials S set in the feed tray 21.

The first separation roller 24 is disposed in front of the first pickup roller 23. The first separation roller 24 is rotatable around an axis extending along the left-to-right direction.

When the feed tray 21 is attached in the attachment position inside the housing 11, the first separation pad 25 contacts a circumferential surface of the first separation roller 24 from a lower front side of the first separation roller 24.

When the multi-purpose tray 13 is in the usable position, a feeding port 31 is open at the front face 12 of the housing 11. The feeding port 31 is configured to let the inside and the outside of the housing 11 communicate with each other therethrough. At the back of the feeding port 31, a second feeding mechanism 32 is disposed. The second feeding mechanism 32 includes a pickup pad 33, a second pickup roller 34, a second separation roller 35, and a second separation pad 36.

The pickup pad 33 is disposed at the back of a lower end portion of the feeding port 31.

The second pickup roller 34 is disposed on the pickup pad 33. The second pickup roller 34 is rotatable around an axis extending along the left-to-right direction. A circumferential surface of the second pickup roller 34 is in contact with an upper surface of a front end portion of a top one of recording materials S set on the multi-purpose tray 13. The second separation roller 35 is disposed at the back of the second pickup roller 34. The second separation roller 35 is rotatable around an axis extending along the left-to-right direction. The second separation pad 36 contacts a circumferential surface of the second separation roller 35 from a lower rear side of the second separation roller 35.

An image former 41 is disposed at a middle portion in the front-to-rear direction inside the housing 11. The image former 41 includes a photoconductive drum 42, a charger 43, a transfer roller 44, a developer 45, a fuser 46, and an exposurer 53. The photoconductive drum 42 is rotatable around an axis extending along the left-to-right direction.

The charger 43 is disposed on an upper rear side of the photoconductive drum 42. For instance, the charger 43 may be a scorotron type charger having a wire and a grid. The transfer roller 44 is disposed to face the photoconductive drum 42, under the photoconductive drum 42. The transfer roller 44 is rotatable around an axis extending along the left-to-right direction.

The developer 45 is disposed in front of the photoconductive drum 42. The developer 45 includes a developer housing 47 and a development roller 48. The developer housing 47 is configured to store toner therein. The development roller 48 is held by the developer housing 47. The development roller 48 is rotatable around an axis extending along the left-to-right direction. A circumferential surface of the development roller 48 is in contact with a circumferential surface of the photoconductive drum 42.

The fuser 46 includes a heating roller 51 and a pressing roller 52. The heating roller 51 is rotatable around an axis extending along the left-to-right direction. The pressing roller 52 is disposed on a lower rear side of the heating roller 51. The pressing roller 52 is rotatable around an axis extending along the left-to-right direction. A circumferential surface of the pressing roller 52 is in contact with a circumferential surface of the heating roller 51.

The exposurer 53 is disposed at an upper section inside the housing 11. The exposurer 53 includes an optical system such as a laser and a polygon mirror. The exposurer 53 is configured to emit a laser beam based on image data. As indicated by a dashed line in FIG. 1, the laser beam emitted by the exposurer 53 is delivered onto the circumferential surface of the photoconductive drum 42 through a space between the charger 43 and the developer 45.

The laser printer 1 further includes, inside the housing 11, registration rollers 61, discharge rollers 62, first conveyance rollers 63, second conveyance rollers 64, first inversion rollers 65, and second inversion rollers 66.

The registration rollers 61 are disposed in front of the photoconductive drum 42 and the transfer roller 44. The registration rollers 61 are spaced a particular distance apart from the photoconductive drum 42 and the transfer roller 44 in the front-to-rear direction. The registration rollers 61 include a driving roller and a driven roller. Each of the registration rollers 61 is rotatable around an axis extending along the left-to-right direction. Respective circumferential surfaces of the driving roller and the driven roller, included in the registration rollers 61, are in contact with each other.

At a rear section of the housing 11, a discharge port 68 is formed. The discharge port 68 is configured such that a recording material S is discharged out of the housing 11 therethrough. The discharge rollers 62 are disposed at the back of the discharge port 68. The discharge rollers 62 include a driving roller and two driven rollers. Each of the discharge rollers 62 is rotatable around an axis extending along the left-to-right direction. Further, each of the discharge rollers 62 is rotatable in a forward direction and a backward direction. A circumferential surface of the driving roller of the discharge rollers 62 is in contact with a circumferential surface of each driven roller of the discharge rollers 62.

The first conveyance rollers 63 are disposed on an upper front side of the first feeding mechanism 22. The first conveyance rollers 63 include a driving roller and a driven roller. Each of the first conveyance rollers 63 is rotatable around an axis extending along the left-to-right direction. Respective circumferential surfaces of the driving roller and the driven roller, included in the first conveyance rollers 63, are in contact with each other.

The second conveyance rollers 64 are disposed on an upper rear side of the fuser 46 and on a lower rear side of the discharge rollers 62. The second conveyance rollers 64 include a driving roller and a driven roller. Each of the second conveyance rollers 64 is rotatable around an axis extending along the left-to-right direction. Respective circumferential surfaces of the driving roller and the driven roller, included in the second conveyance rollers 64, are in contact with each other.

The first inversion rollers 65 and the second inversion rollers 66 are disposed between the feed tray 21 and the image former 41 in the vertical direction. Further, the first inversion rollers 65 are spaced a particular distance apart from the second inversion rollers 66 in the front-to-rear direction. The first inversion rollers 65 are positioned at the back of the second inversion rollers 66. The first inversion rollers 65 include a driving roller and a driven roller. Each of the first inversion rollers 65 is rotatable around an axis extending along the left-to-right direction. Respective circumferential surfaces of the driving roller and the driven roller, included in the first inversion rollers 65, are in contact with each other.

The second inversion rollers 66 are positioned in front of the first inversion rollers 65. The second inversion rollers 66 include a driving roller and a driven roller. Each of the second inversion rollers 66 is rotatable around an axis extending along the left-to-right direction. Respective circumferential surfaces of the driving roller and the driven roller, included in the second inversion rollers 66, are in contact with each other.

The housing 11 has therein a first conveyance path 71, a second conveyance path 72, and a third conveyance path 73.

The first conveyance path 71 passes through a position between the first separation roller 24 and the first separation pad 25, and further passes through a position between the first conveyance rollers 63. After that, the first conveyance path 71 curves toward an upper rear side in a U-shape, and thereafter extends rearward. Moreover, the first conveyance path 71 passes through a position between the registration rollers 61, a position (hereinafter, which may be referred to as a "first position P1") between the photoconductive drum 42 and the transfer roller 44, and a position between the heating roller 51 and the pressing roller 52 of the fuser 46, in the aforementioned order. Furthermore, the first conveyance path 71 extends toward an upper rear side from the fuser 46, then passes through a position between the second conveyance rollers 64, thereafter curves toward an upper front side in a U-shape, and extends up to the discharge port 68 via a position between the discharge rollers 62.

The second conveyance path 72 diverges from the first conveyance path 71 at a diverging point D1 positioned between the discharge rollers 62 and the second conveyance rollers 64. After that, the second conveyance path 72 extends downward behind the first conveyance path 71, then curves frontward, and thereafter passes through a position between the first inversion rollers 65 and a position between the second inversion rollers 66, in the aforementioned order. Afterward, the second conveyance path 72 joins the first conveyance path 71 at a first junction J1 positioned between the registration rollers 61 and the first conveyance rollers 63.

The third conveyance path 73 extends rearward from the feeding port 31, and then passes through a position between the pickup pad 33 and the second pickup roller 34 and a position between the separation roller 35 and the separation pad 36, in the aforementioned order. Afterward, the third conveyance path 73 joins, from the front, the first conveyance path 71 at a second junction J2 positioned between the first conveyance rollers 63 and the first junction J1.

Between the first junction J1 and the registration rollers 61, an actuator of a pre-registration sensor 81 is disposed. The pre-registration sensor 81 is configured to detect a recording material S having reached the registration rollers 61. The actuator 82 protrudes into the first conveyance path 71 from beneath.

In a second position P2 on the first conveyance path 71 between the actuator 82 of the pre-registration sensor 81 and the registration rollers 61, a surface characteristic sensor 83 (hereinafter, which may be referred to as a "first sensor") is disposed. The surface characteristic sensor 83 is configured to detect surface characteristics of a recording material S being conveyed along the first conveyance path 71. Further, in a third position P3 on the first conveyance path 71 between the actuator 82 of the pre-registration sensor 81 and the registration rollers 61, a basis weight sensor 85 (hereinafter, which may be referred to as a "second sensor") is disposed. The basis weight sensor 85 is configured to detect a basis weight of the recording material S being conveyed along the first conveyance path 71. The second position P2 and the third position P3 are coincident with each other in the front-to-rear direction but different from each other in the left-to-right direction. Namely, the surface characteristic sensor 83 and the basis weight sensor 85 are disposed side by side in a width direction (i.e., the left-to-right direction). It is noted that the "basis weight" is a weight per unit area of the recording material S.

Further, the first conveyance path 71 has a specific space 84 between the first junction J1 and the second junction J2. The specific space 84 is wider in the vertical direction than any other portion of the first conveyance path 71.

<Electrical Configuration>

Figure 2:
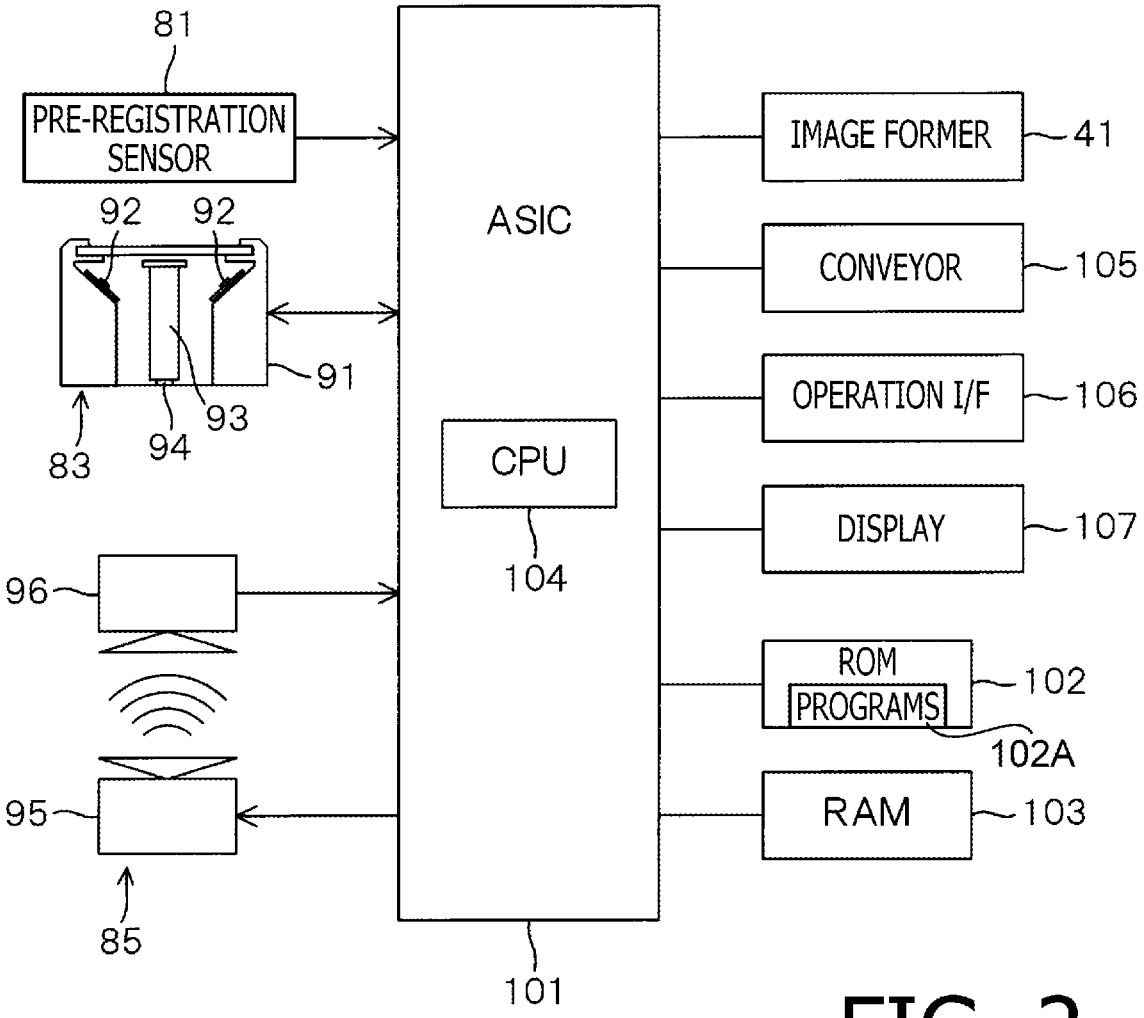
FIG. 2 is a block diagram showing an electrical configuration of the laser printer in the first illustrative embodiment according to one or more aspects of the present disclosure.

As shown in FIG. 2, the surface characteristic sensor 83 includes a line sensor with a light source incorporated therein. Specifically, the surface characteristic sensor 83 includes a line sensor that has an LED ("LED" is an abbreviation of "Light Emitting Diode") array 92, a rod lens array 93 and a CMOS ("CMOS" is an abbreviation of "Complementary Metal-Oxide Semiconductor") array 94 inside a housing 91 of the sensor 83. The surface characteristic sensor 83 is configured to scan a surface of a recording material S being conveyed along the first conveyance path 71. Hence, surface characteristics of the recording material S may be detected based on output signals from the surface characteristic sensor 83.

The basis weight sensor 85 includes an ultrasonic sensor that has an ultrasonic oscillator 95 and an ultrasonic receiver 96. The ultrasonic oscillator 95 is configured to generate ultrasonic waves. The ultrasonic receiver 96 is configured to receive ultrasonic waves. More specifically, the ultrasonic oscillator 95 and the ultrasonic receiver 96 have piezoelectric elements, respectively. When a pulse voltage is applied to the piezoelectric element of the ultrasonic oscillator 95, the piezoelectric element oscillates, and an ultrasonic wave is emitted by the ultrasonic oscillator 95. When there exists a recording material S between the ultrasonic oscillator 95 and the ultrasonic receiver 96, the recording material S is vibrated by the ultrasonic wave, and the ultrasonic receiver 96 detects and converts the vibration of the recording material S into an electric signal. The vibration of the recording material S caused by the ultrasonic wave has an amplitude depending on a basis weight of the recording material S. Thus, it is possible to detect the basis weight of the recording material S based on an output signal (e.g., an output voltage) from the ultrasonic receiver 96.

The laser printer 1 includes an ASIC ("ASIC" is an abbreviation of "Application Specific Integrated Circuit") 101, a ROM ("ROM" is an abbreviation of "Read Only Memory") 102, and a RAM ("RAM" is an abbreviation of "Random Access Memory") 103.

The ASIC 101 is connected with the pre-registration sensor 81, the surface characteristic sensor 83, and the basis weight sensor 85. Thereby, the ASIC 101 may receive detection signals from the pre-registration sensor 81, the surface characteristic sensor 83, and the basis weight sensor 85. The ASIC 101 has a CPU 104 incorporated therein. The CPU 104 may control the image former 41 and a conveyor 105 by executing programs 102A stored in the ROM 102, based on information input into the ASIC 101. It is noted that the conveyor 105 includes the first feeding mechanism 22, the second feeding mechanism 32, the registration rollers 61, the discharge rollers 62, the first conveyance rollers 63, the second conveyance rollers 64, the first inversion rollers 65, and the second inversion rollers 66.

Further, the laser printer 1 includes an operation I/F ("I/F" is an abbreviation of "interface") 106 and a display 107. The operation I/F 106 includes operable keys (e.g., a Start key and a Back key). When an operable key is operated, the operation I/F 106 accepts the operation and transmits to the ASIC 101 a signal (i.e., data) corresponding to the operation. For instance, the display 15 includes an LCD device.

The operation I/F 106 and the display 107 may form a touch panel. The display 107 included in the touch panel may display various kinds of information and images of operable buttons. When a user touches an operable button displayed on the display 107, the operation I/F 106 accepts the touch operation and transmits to the ASIC 101 a signal (i.e., data) corresponding to the touch operation.

The ROM 102 may be a non-volatile rewritable memory such as a flash memory. The ROM 102 is configured to store various kinds of data and the programs 102A executable by the CPU 104.

The RAM 103 may be a volatile memory such as a DRAM ("DRAM" is an abbreviation of "Dynamic Random Access Memory"). The RAM 103 is usable as a work area when the CPU 104 executes the programs 102A.

<Printing Process>

Figure 3:
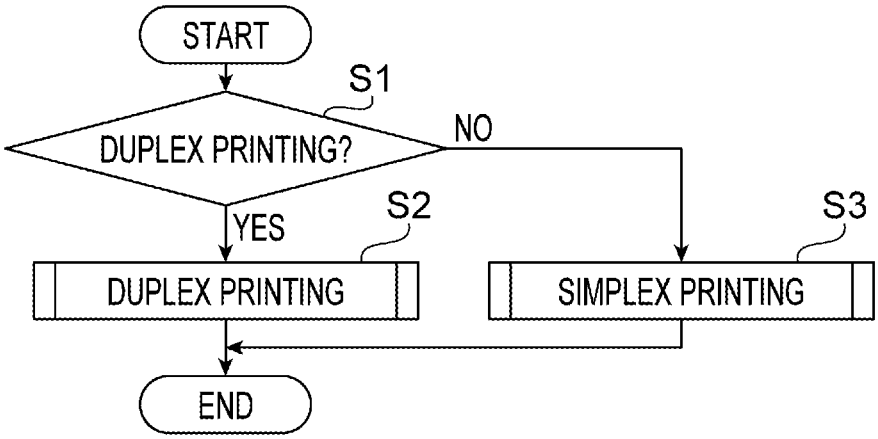
FIG. 3 is a flowchart showing a procedure of a printing process in the first illustrative embodiment according to one or more aspects of the present disclosure.

In response to the ASIC 101 receiving data of a print job along with an instruction to execute the print job from an external terminal (e.g., a PC) communicably connected with the ASIC 101, the CPU 104 performs a printing process as shown in FIG. 3. It is noted that the printing process may be performed by the CPU 104 executing one or more programs 102A stored in the ROM 102. The print job is for causing the laser printer 1 to print an image based on image data on a recording material S (e.g., a sheet). The data of the print job contains information such as the image data and image forming conditions.

In the printing process, the CPU 104 determines whether duplex printing is set, based on the data of the print job (S1). The laser printer 1 is configured to perform simplex printing to form an image on only a single side of each recording material S and perform duplex printing to form images on both sides of each recording material S.

When determining that duplex printing is set (S1: Yes), the CPU 104 performs a duplex printing process (S2). Meanwhile, when determining that duplex printing is not set (i.e., simplex printing is set) (S1: No), the CPU 104 performs a simplex printing process (S3).

<First Example of Duplex Printing Process>

Figure 4A:
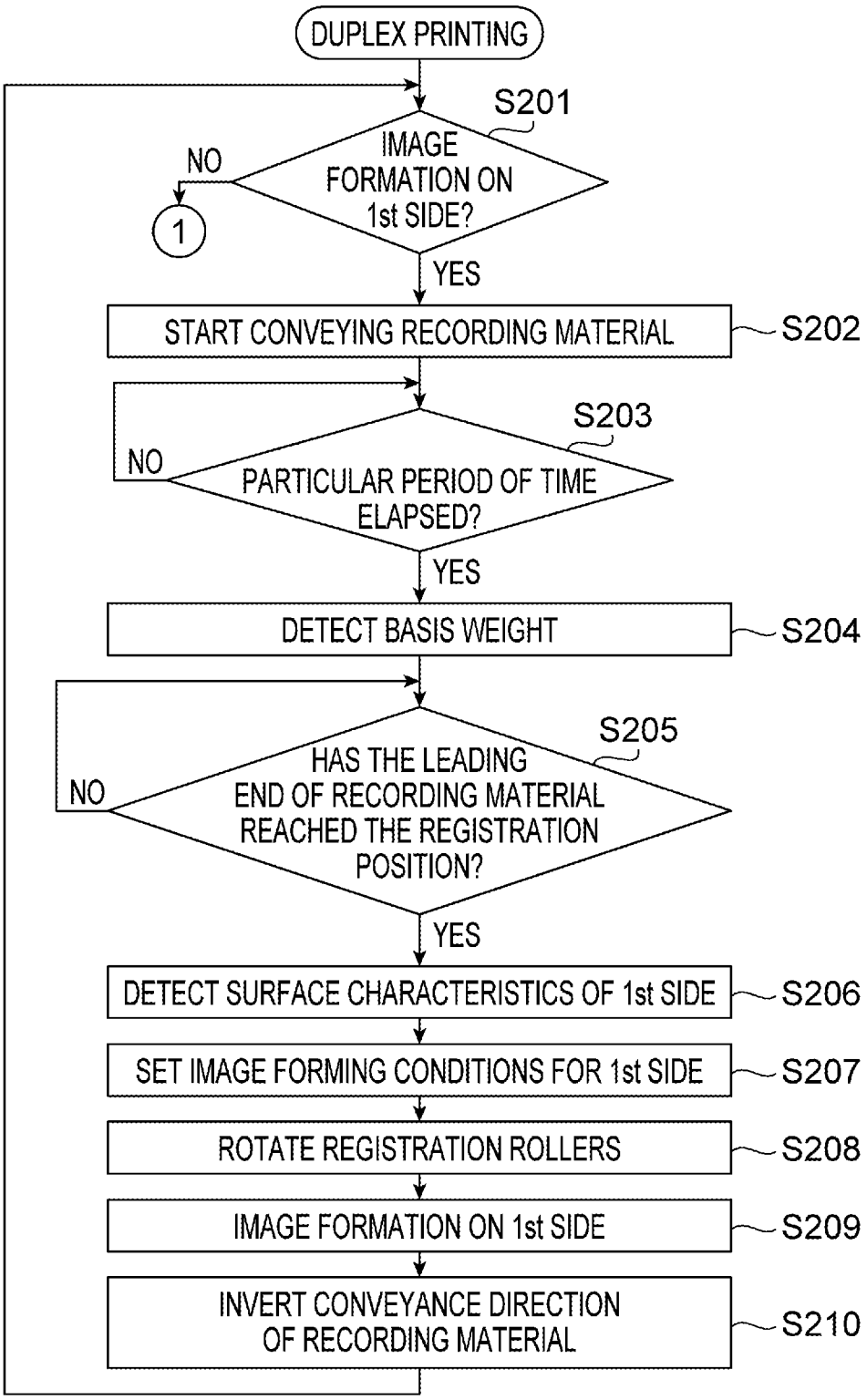
FIGS. 4A and 4B are flowcharts showing a procedure of a first example of a duplex printing process in the first illustrative embodiment according to one or more aspects of the present disclosure.
Figure 4B:
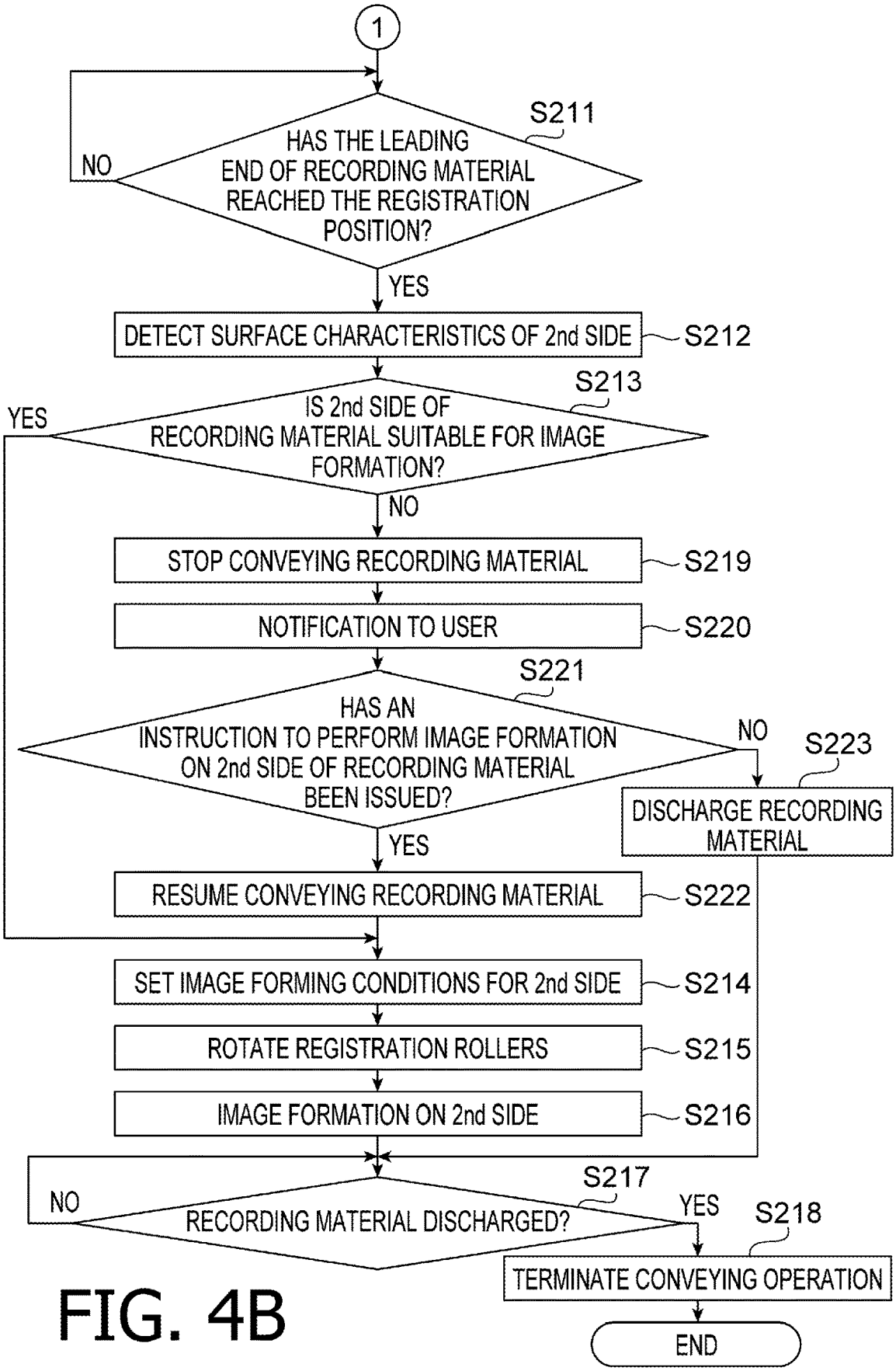

FIGS. 4A and 4B are flowcharts showing a procedure of a first example of the duplex printing process. In the duplex printing process, the CPU 104 of the ASIC 101 determines whether a printing operation to be performed from now is image formation on a first side of a recording material S (S201). It is noted that the first side is one of two mutually-opposite surfaces of the recording material S (i.e., the recording material S has the first side and a second side opposite to each other).

When determining that the printing operation to be performed from now is image formation on the first side of the recording material S (S201: Yes), the CPU 104 controls the conveyor 105 to start conveying the recording material S (S202). When the conveyor 105 begins to convey the recording material S, the recording material S is fed out of the feed tray 21 or the multi-purpose tray 13.

Specifically, to feed the recording material S out of the feed tray 21, the CPU 104 controls the conveyor 105 to rotate the first pickup roller 23 of the first feeding mechanism 22. In response to the rotation of the first pickup roller 23, the recording material S in contact with the circumferential surface of the first pickup roller 23 is fed frontward. The recording material S fed from the feed tray 21 is separated from any other recording material S after passing between the first separation roller 24 and the first separation pad 25, and enters the first conveyance path 71.

To feed the recording material S out of the multi-purpose tray 13, the CPU 104 controls the conveyor 105 to rotate the second pickup roller 34 of the second feeding mechanism 32. In response to the rotation of the second pickup roller 34, the recording material S in contact with the circumferential surface of the second pickup roller 34 is fed rearward. The recording material S fed from the multi-purpose tray 13 is separated from any other recording material S after passing between the second separation roller 35 and the second separation pad 36, is conveyed along the third conveyance path 73, and then enters the first conveyance path 71 from the second junction J2.

At the same time as beginning to convey the recording material S, the CPU 104 activates a timer (not shown) to start measuring an elapsed period of time after the recording material S begins to be conveyed. When a particular period of time has elapsed since the recording material S began to be conveyed (S203: Yes), a leading end of the recording material S in a conveyance direction reaches the third position P3. At this moment, the CPU 104 starts detecting a basis weight of the recording material S by the basis weight sensor 85 (S204).

Afterwards, based on a detection signal from the pre-registration sensor 81, the CPU 104 determines whether the leading end of the recording material S has reached a registration position P4 (S205). The registration position P4 is a contact position between the respective circumferential surfaces of the driving roller and the driven roller of the registration rollers 61. A distance between a position of the actuator 82 of the pre-registration sensor 81 and the registration position P4 is constant. Therefore, when a predetermined period of time has elapsed since the pre-registration sensor 81 detected the leading end of the recording material S in the position of the actuator 82, the CPU 104 may determine that the leading end of the recording material S has reached the registration position P4.

At this time, the registration rollers 61 are still without rotating. Therefore, when the leading end of the recording material S reaches the registration position P4, the leading end of the recording material S stops there, and the recording material S is bent between the leading end thereof and a portion thereof pinched between the first conveyance rollers 63. The specific space 84 formed between the junctions J1 and J2 is configured to accept the bending of the recording material S.

In the state where the leading end of the recording material S stops in the registration position P4, by the surface characteristic sensor 83 disposed in the second position P2 on the first conveyance path 71 between the pre-registration sensor 81 and the registration rollers 61, the CPU 104 starts detecting surface characteristics of the first side of the recording material S (S206). By this time, the basis weight sensor 85 has finished detecting the basis weight of the recording material S.

After having finished detecting the basis weight of the recording material S by the basis weight sensor 85 and detecting the surface characteristics of the first side of the recording material S by the surface characteristic sensor 83, the CPU 104 sets image forming conditions in accordance with results of the detections by the sensors 83 and 85 (S207). For instance, the image forming conditions according to the results of the detections by the sensors 83 and 85 may include transfer conditions and fixing conditions. For instance, the transfer conditions may include a transfer bias (i.e., a transfer voltage) to be applied to the transfer roller 44 when a toner image formed on the photoconductive drum 42 is transferred onto the recording material S. Further, the transfer conditions may include a conveyance speed for conveying the recording material S when the toner image formed on the photoconductive drum 42 is transferred onto the recording material S. For instance, the fixing conditions may include a fixing temperature for fixing the toner image when the recording material S passes through the fuser 46, and a conveyance speed for the recording material S to pass through the fuser 46. Afterward, the CPU 104 controls the conveyor 105 to start rotating the registration rollers 61 (S208).

Meanwhile, the CPU 104 controls the image former 41 to start an image forming operation (S209). In the image forming operation, the photoconductive drum 42 is rotated at a constant rotational speed. Along with the rotation of the photoconductive drum 42, the surface of the photoconductive drum 42 is evenly charged by the charger 43 and thereafter selectively exposed to the laser beam emitted by the exposurer 53. Thus, when the evenly-charged surface of the photoconductive drum 42 is selectively exposed, electric charges are selectively removed from the surface of the photoconductive drum 42. Thereby, an electrostatic latent image is formed on the surface of the photoconductive drum 42. Further, when supplied with toner from the development roller 48, the electrostatic latent image is developed to a toner image on the surface of the photoconductive drum 42.

Forming the toner image and feeding the recording material S by the registration rollers 61 are performed in synchronization with each other. Specifically, the registration rollers 61 begin to be rotated at such timing as to put the recording material S between the photoconductive drum 42 and the transfer roller 44 when the toner image on the photoconductive drum 42 faces the transfer roller 44. The transfer roller 44 is supplied with the transfer bias. When the recording material S passes between the photoconductive drum 42 and the transfer roller 44, the toner image on the surface of the photoconductive drum 42 is transferred onto the first side (i.e., an upward-facing surface) of the recording material S by the action of the transfer bias.

The recording material S with the toner image transferred thereon is further conveyed rearward into the fuser 46, along the first conveyance path 71. In the fuser 46, the recording material S passes between the heating roller 51 and the pressing roller 52. At this time, the toner image is fixed onto the recording material S by the action of heating and pressing. Thereby, the image is formed on the recording material S. Thus, the recording material S with the image formed on the first side is further conveyed along the first conveyance path 71.

When the recording material S is further conveyed up to such a position that a trailing end portion (an upstream end portion) of the recording material S in the conveyance direction is pinched between the discharge rollers 62, the CPU 104 controls the conveyor 105 to invert the rotational direction of the discharge rollers 62 (S210). Thereby, the recording material S enters the second conveyance path 72 without being discharged onto the discharge tray 14.

The recording material S, having entered the second conveyance path 72, sequentially receives conveyance forces from the first inversion rollers 65 and the second inversion rollers 66, thereby proceeding forward along the second conveyance path 72. Then, the recording material S enters the first conveyance path 71 via the first junction J1. Thus, the first and second sides of the recording material S are inverted, and the recording material S is further conveyed with the second side facing upward, toward the photoconductive drum 42 along the first conveyance path 71.

The CPU 104 again determines whether a next printing operation is image formation on the first side of the recording material S (S201). Since the next printing operation is image formation on the second side of the recording material S (S201: No), the CPU 104 determines whether the leading end of the recording material S in the conveyance direction has reached the registration position P4, based on the detection signal from the pre-registration sensor 81 (S211).

When determining that the leading end of the recording material S in the conveyance direction has reached the registration position P4 (S211: Yes), the CPU 104 begins to detect surface characteristics of the second side of the recording material S by the surface characteristic sensor 83 (S212).

After detecting the surface characteristics of the second side of the recording material S, the CPU 104 determines whether the second side of the recording material S is suitable for image formation, based on the detected surface characteristics (S213). It is noted that, in the present disclosure, "a surface suitable for image formation" may denote a surface having general specifications required for a printing surface. Meanwhile, "a surface unsuitable for image formation" may denote a surface not having the general specifications required for the printing surface. For instance, when the recording material S has a glossy surface as the first side and a non-glossy surface as the second side, the CPU 104 may determine in S213 that the second side of the recording material S is not suitable for image formation (S213: No).

When determining that the second side of the recording material S is suitable for image formation (S213: Yes), the CPU 104 sets image forming conditions in accordance with the detected surface characteristics of the second side of the recording material S (S214). More specifically, at this time, the CPU 104 sets the image forming conditions in accordance with the basis weight previously detected in S204 as well as the surface characteristics of the second side of the recording material S.

Afterward, the CPU 104 begins to rotate the registration rollers 61 (S215). Further, the CPU 104 controls the image former 41 to start an image forming operation (S216). After completion of image formation on the second side of the recording material S, the CPU 104 controls the conveyor 105 to discharge, onto the discharge tray 14, the recording material S with the images formed on both the first and second sides, without inverting the rotational directions of the discharge rollers 62. When the recording material S has been discharged onto the discharge tray 14 (S217: Yes), the CPU 104 controls the conveyor 105 to terminate the conveying operation (S218). Then, the CPU 104 terminates the duplex printing process.

When determining that the second side of the recording material S is not suitable for image formation (S213: No), the CPU 104 controls the conveyor 105 to stop conveying the recording material S (S219).

Then, the CPU 104 controls the display 107 to display a notification that the second side of the recording material S is unsuitable for image formation, thereby letting the user know the notification (S220).

Further, the CPU 104 controls the display 107 to display an inquiry message about whether to perform image formation on the second side of the recording material S, along with a "YES" key and a "NO" key.

When an instruction to perform image formation on the second side of the recording material S has been issued in response to the "YES" key being operated via the operation I/F 106 (S221: Yes), the CPU 104 controls the conveyor 105 to resume conveying the recording material S (S222).

Then, the CPU 104 sets image forming conditions in accordance with the detected surface characteristics of the second side of the recording material S (S214). More specifically, at this time, the CPU 104 sets the image forming conditions in accordance with the basis weight previously detected in S204 as well as the surface characteristics of the second side of the recording material S. Afterward, the CPU 104 begins to rotate the registration rollers 61 (S215). Further, the CPU 104 controls the image former 41 to start an image forming operation (S216). After completion of image formation on the second side of the recording material S, the CPU 104 controls the conveyor 105 to discharge onto the discharge tray 14 the recording material S with the images formed on both the first and second sides, without inverting the rotational direction of the discharge rollers 62. When the recording material S is discharged onto the discharge tray 14 (S217: Yes), the CPU 104 controls the conveyor 105 to terminate the conveying operation (S218). Then, the CPU 104 terminates the duplex printing process.

When an instruction to cancel image formation on the second side of the recording material S is issued in response to the "NO" key being operated via the operation I/F 106 (S221: No), the CPU 104 controls the conveyor 105 to discharge the recording material S onto the discharge tray 14 (S223). When the recording material S is discharged onto the discharge tray 14 (S217: Yes), the CPU 104 controls the conveyor 105 to terminate the conveying operation (S218). Then, the CPU 104 terminates the duplex printing process.

<Simplex Printing Process>

Figure 5:
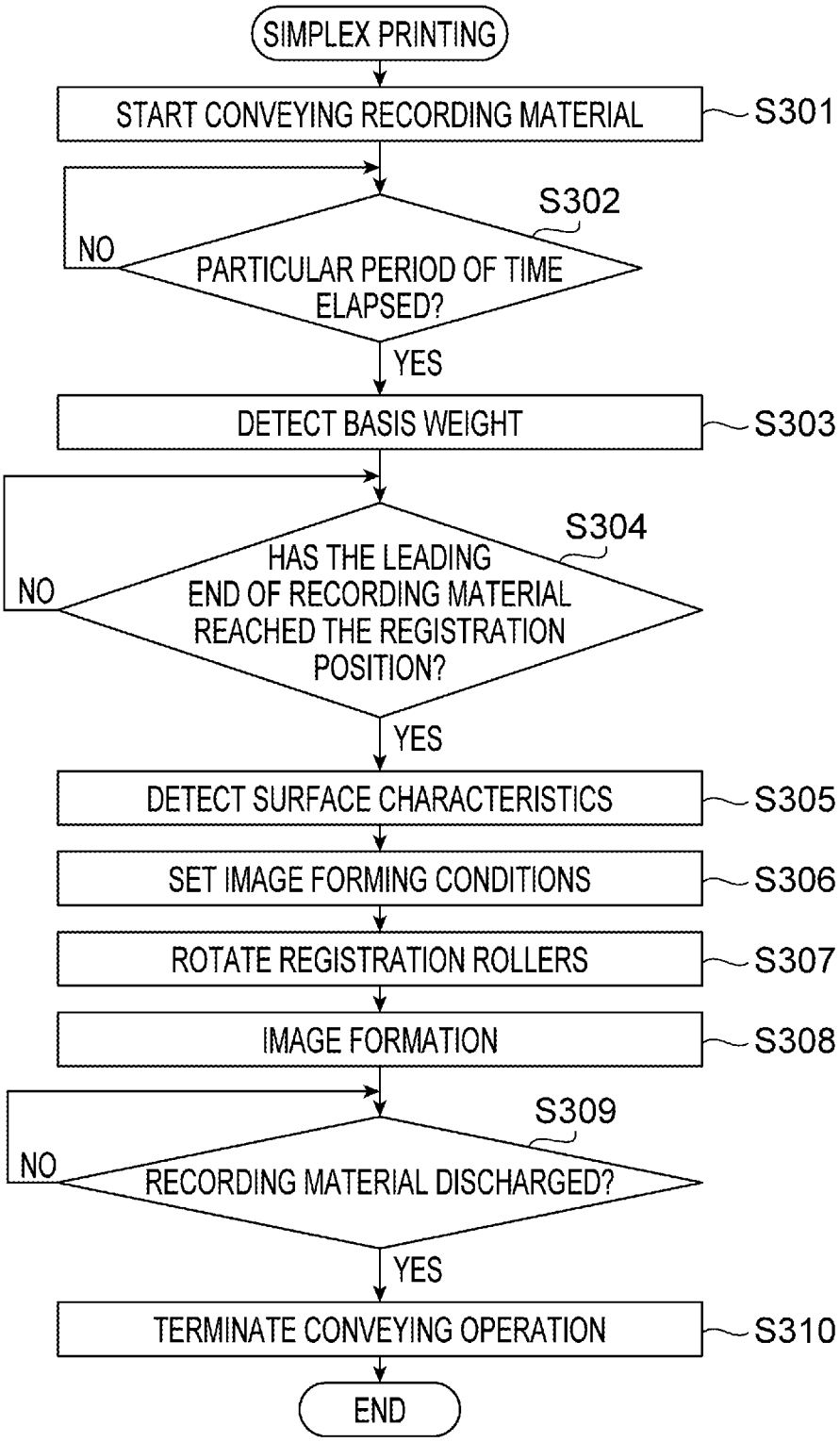
FIG. 5 is a flowchart showing a procedure of a simplex printing process in the first illustrative embodiment according to one or more aspects of the present disclosure.

FIG. 5 is a flowchart showing a procedure of the simplex printing process to form an image on only the first side of a recording material S. In the simplex printing process, the CPU 104 of the ASIC 101 controls the conveyor 105 to start conveying the recording material S (S301). In response to the conveyor 105 beginning to convey the recording material S, the recording material S is fed out of the feed tray 21 or the multi-purpose tray 13.

In the same manner as the duplex printing process, afterward, at the same time as beginning to convey the recording material S, the CPU 104 activates the timer (not shown) to start measuring an elapsed period of time after the recording material S begins to be conveyed. When a particular period of time has elapsed since the recording material S began to be conveyed (S302: Yes), the leading end of the recording material S in the conveyance direction reaches the third position P3. At this moment, the CPU 104 starts detecting a basis weight of the recording material S by the basis weight sensor 85 (S303).

Thereafter, based on the detection signal from the pre-registration sensor 81, the CPU 104 determines whether the leading end of the recording material S has reached the registration position P4 (i.e., a nip position between the registration rollers 61) (S304).

At this time, the registration rollers 61 are still without rotating. Therefore, when the leading end of the recording material S reaches the registration position P4, the leading end of the recording material S stops there, and the recording material S is bent between the leading end thereof and a portion thereof pinched between the first conveyance rollers 63. In the state where the leading end of the recording material S stops in the registration position P4, by the surface characteristic sensor 83 disposed in the second position P2 on the first conveyance path 71 between the pre-registration sensor 81 and the registration rollers 61, the CPU 104 starts detecting surface characteristics of the first side of the recording material S (S305).

After having finished detecting the basis weight of the recording material S and the surface characteristics of the first side of the recording material S, the CPU 104 sets image forming conditions in accordance with the detection results (S306).

Afterward, the CPU 104 controls the conveyor 105 to start rotating the registration rollers 61 (S307). Meanwhile, the CPU 104 controls the image former 41 to start an image forming operation (S308). Thereby, a toner image formed on the surface of the photoconductive drum 42 is transferred onto the first side of the recording material S. Thereafter, the toner image is fixed onto the first side of the recording material S by the fuser 46.

After completion of the image formation on the first side of the recording material S, the CPU 104 controls the conveyor 105 to discharge, onto the discharge tray 14, the recording material S with the image formed on the first side, without inverting the rotational directions of the discharge rollers 62. When the recording material S is discharged onto the discharge tray 14 (S309: Yes), the CPU 104 controls the conveyor 105 to terminate the conveying operation (S310). Then, the CPU 104 terminates the simplex printing process.

<Operations and Advantageous Effects>

On the first conveyance path 71, the second position P2 and the third position P3 are between the first junction J1 and the first position P1. The surface characteristic sensor 83 for detecting surface characteristics of a recording material S is disposed in the second position P2. The basis weight sensor 85 for detecting a basis weight of the recording material S is disposed in the third position P3. In the duplex printing, when the recording material S passes through the second position P2 and the third position P3 for the first time (the passing which may be hereinafter referred to as the "first passage"), the surface characteristic sensor 83 detects surface characteristics of a first side of the recording material S, and the basis weight sensor 85 detects the basis weight of the recording material S. Then, image forming conditions for the image former 41 to form an image on the first side are set based on the results of the detections by the surface characteristic sensor 83 and the basis weight sensor 85. When the recording material S passes through the second position P2 and the third position P3 for the second time (the passing which may be hereinafter referred to as the "second passage"), image forming conditions for the image former 41 to form an image on a second side of the recording material S are set based on surface characteristic of the second side detected during the second passage and the basis weight of the recording material S detected during the first passage, with no need to detect the basis weight of the recording material S during the second passage.

Therefore, in the first illustrative embodiment, it is possible to make shorter a period of time required for duplex printing for a single recording material S than when detection of surface characteristics of a specific side of the recording material S by the surface characteristic sensor 83 and detection of a basis weight of the recording material S by the basis weight sensor 85 are both performed such that image forming conditions are set based on the surface characteristics and the basis weight each time the recording material S passes through the second position P2 and the third position P3 during the duplex printing. For instance, in the first illustrative embodiment, when the recording material S passes through the second position P2 and the third position P3 for the second time, the laser printer 1 (more specifically, the CPU 104) may omit an operation of detecting the basis weight of the recording material S during the second passage, by using the basis weight detected during the first passage. Thus, it is possible to reduce a period of time required for detections by the surface characteristic sensor 83 and the basis weight sensor 85 during the duplex printing. Further, when the recording material S passes through the second position P2 and the third position P3 for the second time, since the basis weight of the recording material S has already been detected during the first passage, the laser printer 1 (more specifically, the CPU 104) may determine the image forming conditions for the image former 41 to form an image on the second side at a point of time when the detection of the surface characteristics of the second side has been completed. Thus, it is possible to reduce a period of time required to adjust the image forming conditions for the image former 41.

The surface characteristics may be different between the first side and the second side of the recording material S. By detecting the surface characteristics of each side of the recording material S, the image former 41 may perform image formation under the image forming conditions adjusted for the surface characteristics of each side of the recording material S. Meanwhile, the basis weight of the recording material S is constant. Therefore, when the basis weight of the recording material S is detected during the first passage, there is no need to again detect the basis weight of the recording material S during the second passage. Thus, it is possible to improve throughput of the duplex printing as well as to identify a type of the recording material S.

Further, in the duplex printing, when the surface characteristics of the second side of the recording material S is detected to be unsuitable for image formation, the detection result is displayed on the display 107, thereby notified to the user. Then, when an instruction to cancel image formation on the second side of the recording material S is issued, the recording material S is discharged onto the discharge tray 14. Thus, when the second side of the recording material S is unsuitable for image formation, it is possible to prevent image formation on the second side of the recording material S.

<Second Example of Duplex Printing Process>

In the aforementioned first example of the duplex printing process, when the second side of the recording material S is determined to be unsuitable for image formation based on the detected surface characteristics of the second side, the user determines whether to continue to perform image formation on the second side of the recording material S.

Figure 6A:
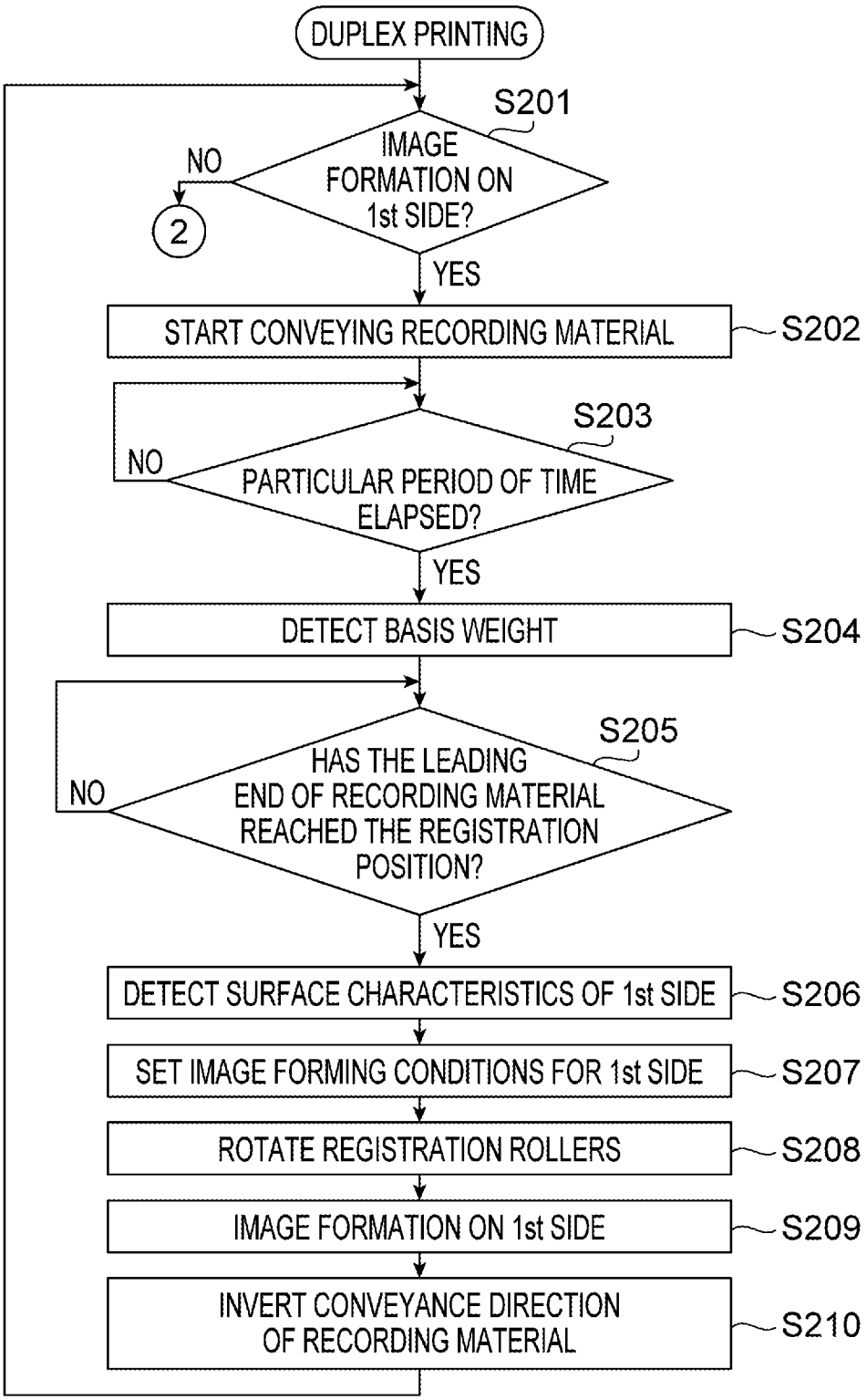
FIGS. 6A and 6B are flowcharts showing a procedure of a second example of the duplex printing process in the first illustrative embodiment according to one or more aspects of the present disclosure.
Figure 6B:
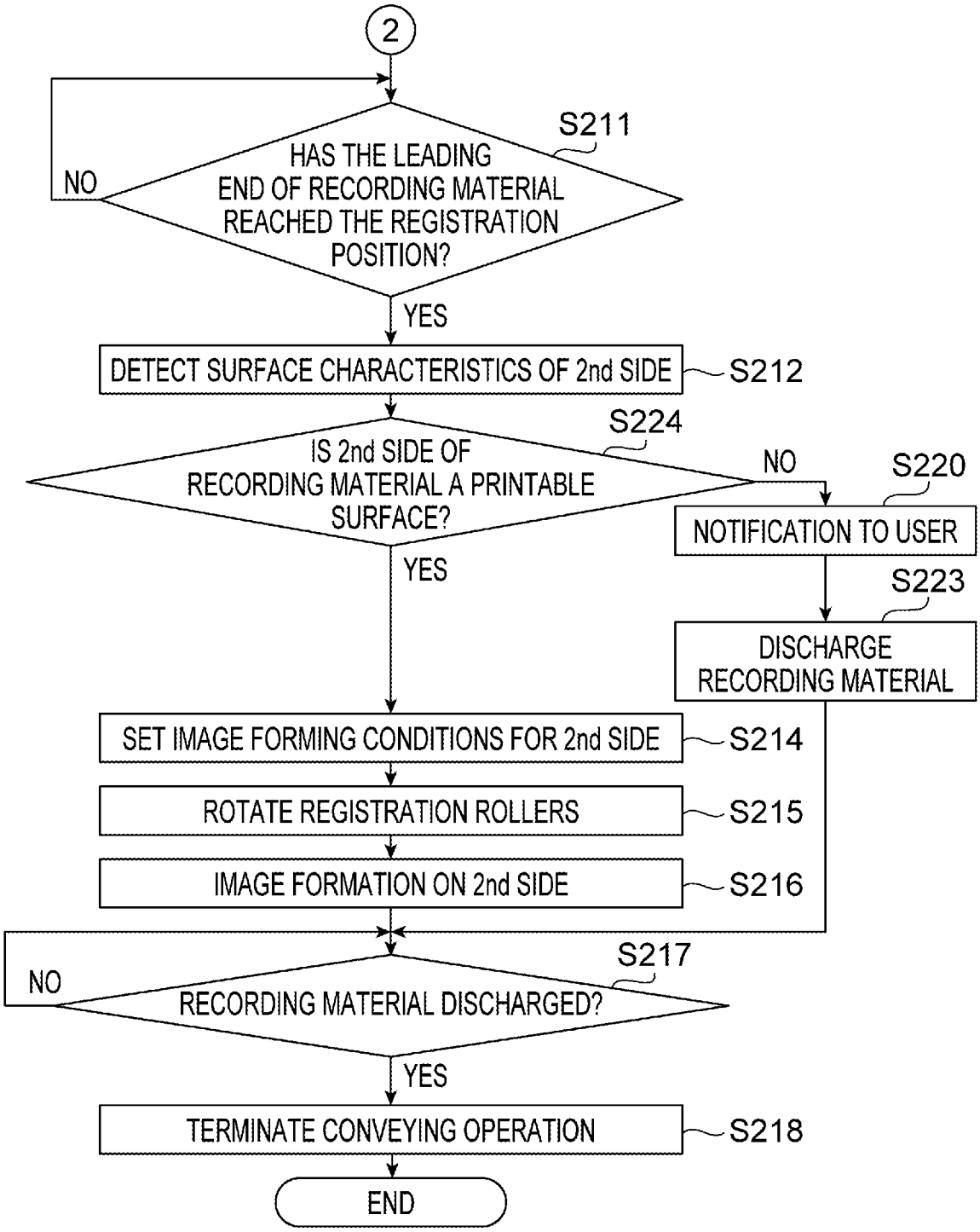

FIGS. 6A and 6B are flowcharts showing a procedure of a second example of the duplex printing process. In the second example of the duplex printing process, after detecting the surface characteristics of the second side of the recording material S, the CPU 104 may determine whether the second side of the recording material S is a printable surface (S224). Then, when determining that the second side of the recording material S is not a printable surface (S224: No), the CPU 104 may provide a notification that the second side of the recording material S is an unprintable surface (S220). In this case, the CPU 104 may control the conveyor 105 to discharge the recording material S onto the discharge tray 14 (S223), without providing the user with an opportunity to determine whether to continue to perform image formation on the second side. Thereafter, the CPU 104 may terminate the duplex printing process. It is noted that, in the present disclosure, "a printable surface" may denote a surface that satisfies general requirements for a printing surface. Meanwhile, "an unprintable surface" may denote a surface that does not satisfy the general requirements for the printing surface. For instance, when the recording material S is a magnet sheet with a printing surface as the first side and a magnet surface as the second side, the CPU 104 may determine in S224 that the second side of the recording material S is not a printable surface (S224: No).

Of course, when determining that the second side of the recording material S is a printable surface (S224: Yes), the CPU 104 may set image forming conditions for the second side based on the detected surface characteristics of the second side (S214), and thereafter may perform the steps following S214. In this case, the image forming conditions for the second side may be set based on the basis weight of the recording material S detected during the first passage and the surface characteristics of the second side detected during the second passage, with no need to detect the basis weight of the recording material S during the second passage. It is noted that, although the basis weight of the recording material S may be detected during the second passage, the basis weight detected during the second passage is not used to set the image forming conditions for the second side.

<Third Example of Duplex Printing Process>

Figure 7A:
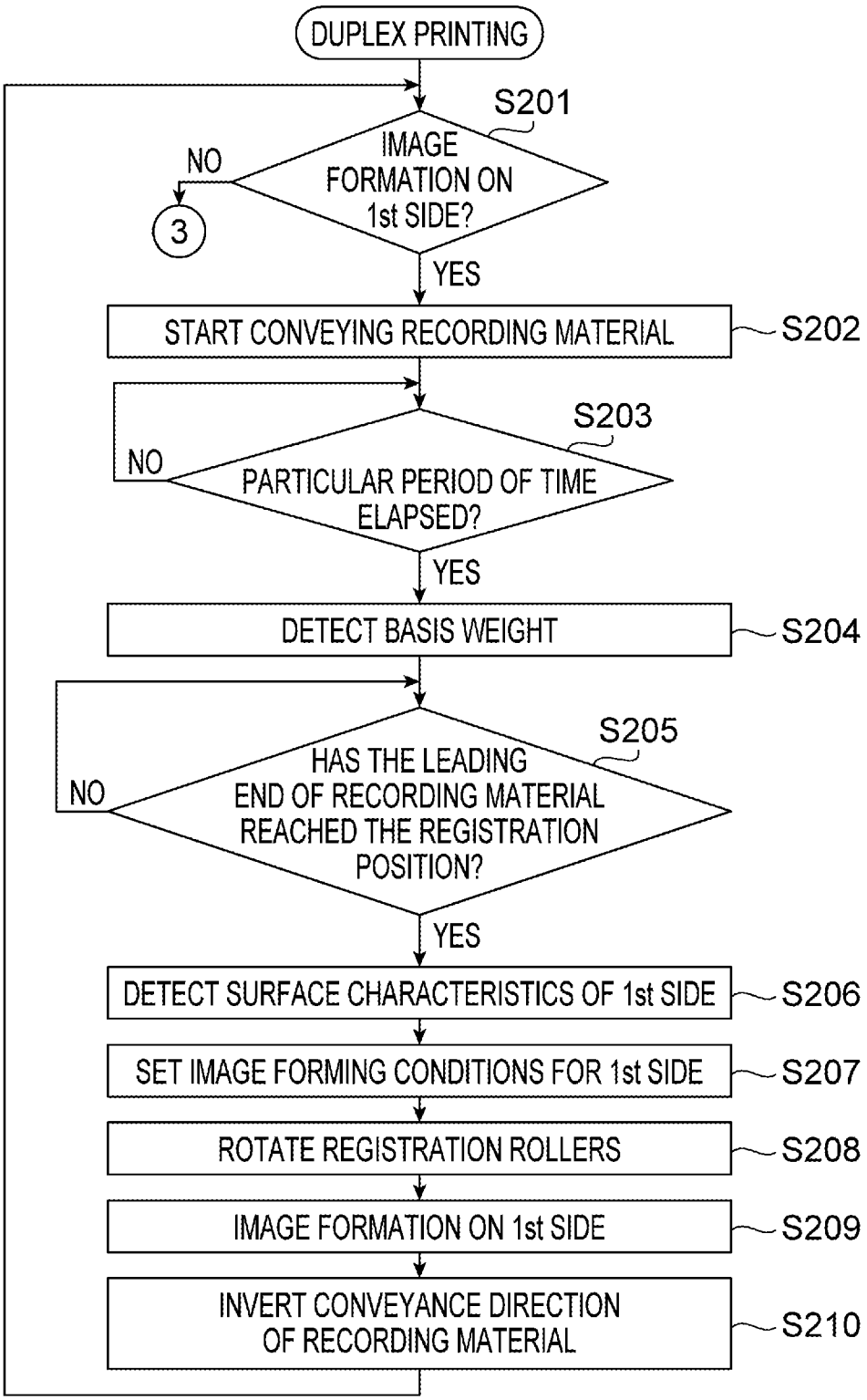
FIGS. 7A and 7B are flowcharts showing a procedure of a third example of the duplex printing process in the first illustrative embodiment according to one or more aspects of the present disclosure.
Figure 7B:
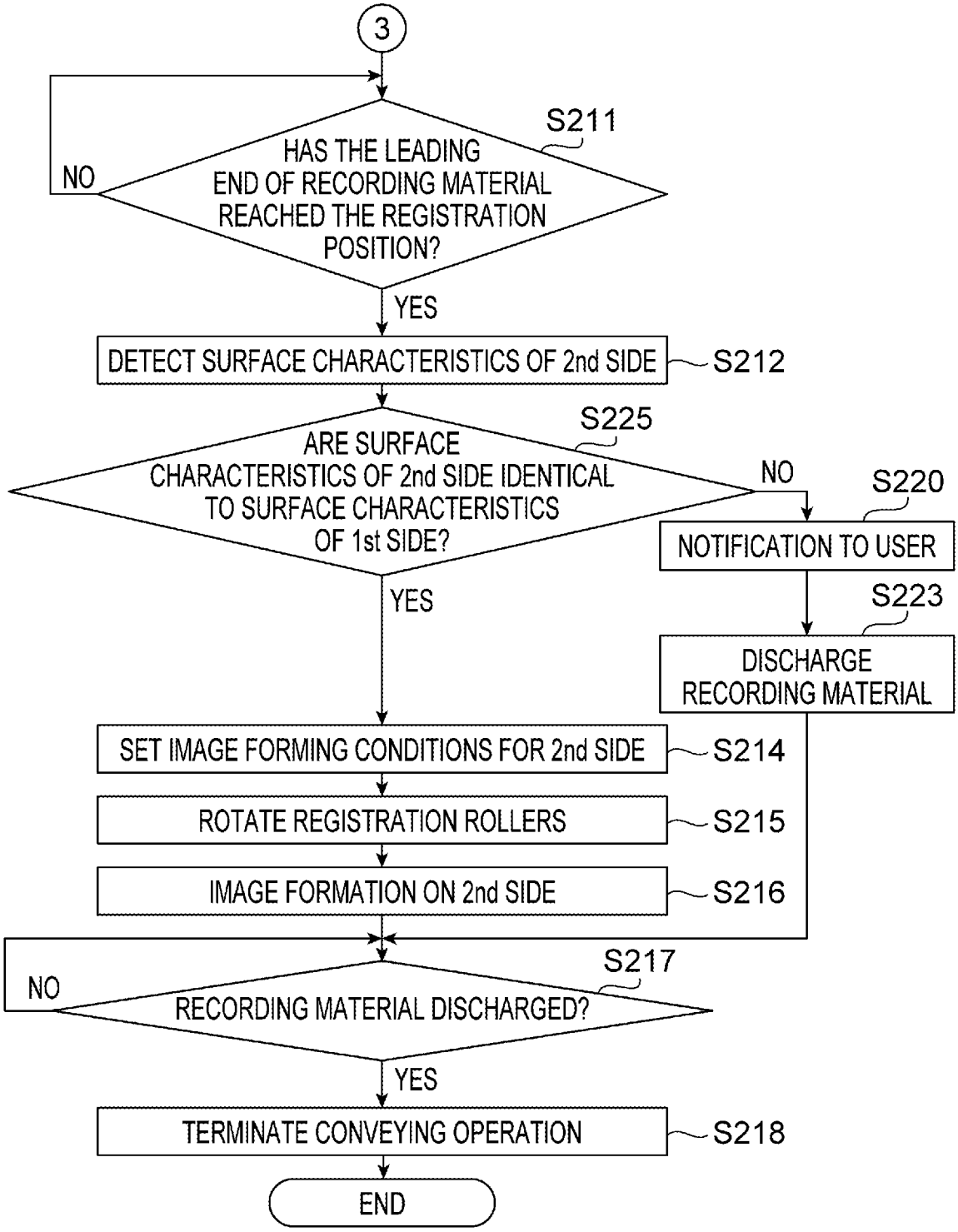

FIGS. 7A and 7B are flowcharts showing a procedure of a third example of the duplex printing process. In the third example of the duplex printing process, after detecting the surface characteristics of the second side of the recording material S, the CPU 104 may determine whether the surface characteristics of the second side are identical to the surface characteristics of the first side (S225). When determining that the surface characteristics of the second side are different from the surface characteristics of the first side (S225: No), the CPU 104 may provide a notification that the surface characteristics of the second side are different from the surface characteristics of the first side (S220). In this case, the CPU 104 may control the conveyor 105 to discharge the recording material S onto the discharge tray 14 (S223), without providing the user with an opportunity to determine whether to continue to perform image formation on the second side, and thereafter may terminate the duplex printing process. Further, in this case, the CPU 104 may perform the same steps as S219 to S222 shown in FIG. 4. Specifically, when determining that the surface characteristics of the second side are different from the surface characteristics of the first side (S225: No), the CPU 104 may control the conveyor 105 to stop conveying the recording material S (S219) and then provide the notification that the surface characteristics of the second side are different from the surface characteristics of the first side (S220). At this time, for instance, the CPU 104 may control the display 107 to display an inquiry message about whether to perform image formation on the second side of the recording material S, along with a "YES" key and a "NO" key. When an instruction to perform image formation on the second side of the recording material S has been issued in response to the "YES" key being operated via the operation I/F 106 (S221: Yes), the CPU 104 may control the conveyor 105 to resume conveying the recording material S (S222). Afterward, the CPU 104 may go to S214.

Of course, when determining that the surface characteristics of the second side are identical to the surface characteristics of the first side (S225: Yes), the CPU 104 may set image forming conditions according to the detected surface characteristics of the second side (S214), and thereafter may perform the steps following S214. In this case, the image forming conditions may be set based on the basis weight of the recording material S detected during the first passage and the surface characteristics of the second side detected during the second passage.

Second Illustrative Embodiment

Figure 8:
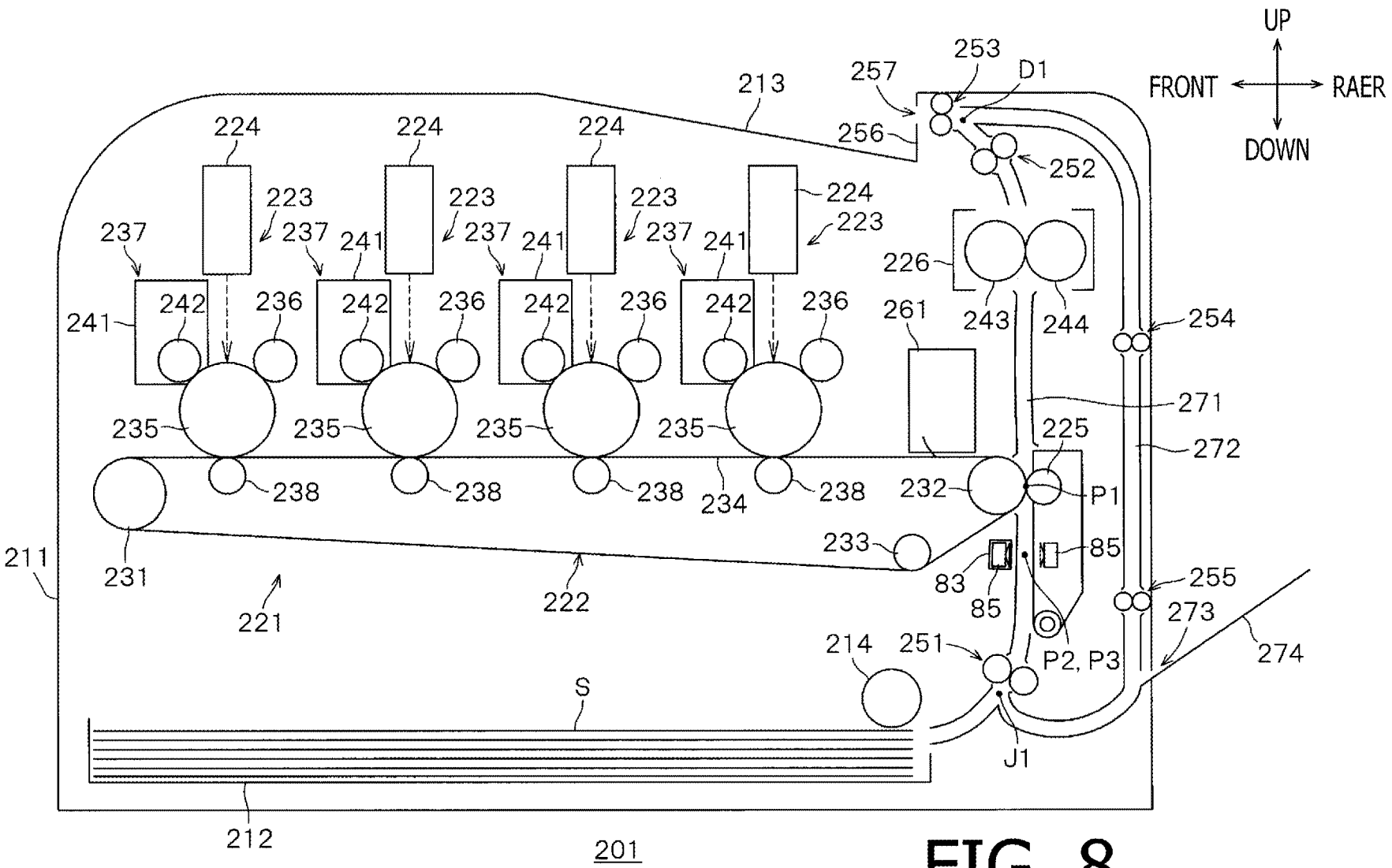
FIG. 8 is a cross-sectional side view schematically showing a configuration of a laser printer in a second illustrative embodiment according to one or more aspects of the present disclosure.

Hereinafter, a second illustrative embodiment according to aspects of the present disclosure will be described. FIG. 8 schematically shows a cross-sectional side view of a color laser printer 201.

The laser printer 201 includes a housing 211 formed substantially in a rectangular parallelepiped shape. A feed tray 212 is attached at a bottom section inside the housing 211 to be drawable frontward out of the housing 211.

In the following description, a "front side" of the laser printer 201 will be defined as a side toward which the feed tray 211 is drawn out of the housing 211. A "rear side" of the laser printer 201 will be defined as an opposite side of the "front side" across the housing 211. Further, on the basis of the laser printer 201 viewed from the "front side," an "upside," a "downside," a "left side," and a "right side" of the laser printer 201 will be defined. In FIG. 8, a vertical direction and a front-to-rear direction according to the aforementioned definitions are indicated by respective arrows.

On an upper face of the housing 211, a discharge tray 213 is formed as a recessed section with a bottom surface inclined to be lower towards the rear. The discharge tray 213 is configured to support a stack of recording materials S discharged thereon.

A third pickup roller 214 is disposed above a rear end portion of the feed tray 212. The third pickup roller 214 is rotatable around an axis extending along the left-to-right direction. When the feed tray 212 is attached inside the housing 211, a circumferential surface of the third pickup roller 214 is in contact with a top one of recording materials S set in the feed tray 212.

Above the feed tray 212 and the third pickup roller 214, an image former 221 is disposed. The image former 221 includes an intermediate transfer belt 222, four process units 223, four exposurers 224, a secondary transfer roller 225, and a fuser 226.

The intermediate transfer belt 222 is an endless belt wound around three rollers 231, 232, and 233. The two rollers 231 and 232 are spaced apart from each other in the front-to-rear direction, and are disposed in such a manner that an upper end of a circumferential surface of the roller 231 is positioned as high as an upper end of a circumferential surface of the roller 232. The roller 233 is disposed at a lower front side of the roller 232. Thereby, the intermediate transfer belt 222 has a flat section 234 extending in both the front-to-rear direction and the left-to-right direction between the upper end of the circumferential surface of the roller 231 and the upper end of the circumferential surface of the roller 232.

The four process units 223 are for four colors (e.g., black, yellow, magenta, and cyan), respectively. Each process unit 223 includes a photoconductive drum 235, a charger 236, a developer 237, and a primary transfer roller 238.

Each photoconductive drum 235 is rotatable around an axis extending along the left-to-right direction. Each charger 236 is disposed at an upper rear side of the corresponding photoconductive drum 235. For instance, each charger 236 may be a charging roller that is rotatable around an axis extending along the left-to-right direction.

Each developer 237 is disposed at an upper front side of the corresponding photoconductive drum 235. Each developer 237 includes a developer housing 241 and a development roller 242. The developer housing 241 is configured to store toner therein. The development roller 242 is held by the developer housing 241. Each primary transfer roller 238 is disposed beneath the flat section 234 of the intermediate transfer belt 222, to face the corresponding photoconductive drum 235 across the flat section 234. Each primary transfer roller 238 is rotatable around an axis extending along the left-to-right direction.

Each exposurer 224 is disposed at an upper section of the corresponding process unit 223. The secondary transfer roller 225 is disposed to face the roller 232 from behind across the intermediate transfer belt 222. The fuser 226 is disposed above the roller 232 and the secondary transfer roller 225 facing each other across the intermediate transfer belt 222.

The laser printer 201 further includes, within the housing 211, first conveyance rollers 251, second conveyance rollers 252, discharge rollers 253, first inversion rollers 254, and second inversion rollers 255.

The first conveyance rollers 251 are disposed below the roller 232 and the secondary transfer roller 225 facing each other across the intermediate transfer belt 222. The second conveyance rollers 252 are disposed above the fuser 226.

A discharge port 257 is formed at a rear portion of the housing 211. The discharge port 257 is configured such that a recording material S is discharge onto the discharge tray 213 therethrough. The discharge rollers 253 are disposed at the back of the discharge port 257. The discharge rollers 253 include a driving roller and a driven roller. Each of the discharge rollers 253 is rotatable around an axis extending along the left-to-right direction. The first inversion rollers 254 and the second inversion rollers 255 are disposed at a rear end section inside the housing 211. The first inversion rollers 254 are spaced apart from the second inversion rollers 255 in the vertical direction.

Further, a belt cleaner 261 is disposed above a rear end portion of the flat section 234 of the intermediate transfer belt 222. The belt cleaner 261 is configured to remove foreign contaminants (e.g., toner) remaining on a surface of the intermediate transfer belt 222. Further, the laser printer 201 has a first conveyance path 271 and a second conveyance path 272 inside the housing 211.

First, the first conveyance path 271 extends from a rear end of the feed tray 212 toward an upper rear side in a manner curved in an arc bulging toward a lower rear side. Then, the first conveyance path 271 passes between the first conveyance rollers 251, and thereafter extends straight upward. Afterward, the first conveyance path 271 passes through a position between the intermediate transfer belt 222 and the secondary transfer roller 225 and a position between a heating roller 243 and a pressing roller 244 of the fuser 226. Then, the first conveyance path 271 extends obliquely frontward from the fuser 226 up to the discharge port 257 via a position between the discharge rollers 253. A first position P1 on the first conveyance path 271 is between the intermediate transfer belt 222 and the secondary transfer roller 225.

The second conveyance path 272 diverges from the first conveyance path 271 at a diverging point D1 positioned between the discharge rollers 253 and the second conveyance rollers 252. Then, the second conveyance path 272 extends downward on the back of the first conveyance path 271, and passes through a position between the first inversion rollers 254 and a position between the second inversion rollers 255, in the aforementioned order. Thereafter, the second conveyance path 272 extends frontward in a manner curved in an arc bulging downward, and joins the first conveyance path 271 at a first junction J1 positioned between the feed tray 212 and the first conveyance rollers 251.

In a rear face of the housing 211, a manual feeding port 273 is formed. The manual feeding port 273 is configured to let the inside and the outside of the housing 211 communicate with each other therethrough. The laser printer 201 has a manual feed tray 274 that extends straight toward an upper rear side from a lower end portion of the manual feeding port 273. When a recording material S set on the manual feed tray 274 is inserted via the manual feeding port 273, the recording material S is fed onto the second conveyance path 272. Then, when a leading end of the recording material S in the conveyance direction reaches the first conveyance rollers 251, the recording material S is supplied with a conveyance force from the first conveyance rollers 251 and thereby conveyed along the first conveyance path 271.

In a second position P2 between the first junction J1 and the first position P1 on the first conveyance path 271, a surface characteristic sensor 83 is disposed. The surface characteristic sensor 83 is configured to detect surface characteristics of a recording material S being conveyed along the first conveyance path 271. Further, in a third position P3 between the first junction J1 and the first position P1 on the first conveyance path 271, a basis weight sensor 85 is disposed. The basis weight sensor 85 is configured to detect a basis weight of the recording material S being conveyed along the first conveyance path 271. The second position P2 and the third position P3 are coincident with each other in the front-to-rear direction but different from each other in the left-to-right direction. Namely, the surface characteristic sensor 83 and the basis weight sensor 85 are disposed side by side in the width direction (i.e., the left-to-right direction).

<Printing Process>

In a printing process, a recording material S is fed from the feed tray 212. At a point of time when a leading end of the recording material S in the conveyance direction reaches the second position P2, the surface characteristic sensor 83 begins to detect surface characteristics of a first side of the recording material S. Further, at a point of time when the leading end of the recording material S reaches the third position P3, the basis weight sensor 85 begins to detect a basis weight of the recording material S.

After having finished detecting the basis weight of the recording material S by the basis weight sensor 85 and detecting the surface characteristics of the first side of the recording material S by the surface characteristic sensor 83, the laser printer 201 (more specifically, a CPU 104) sets image forming conditions in accordance with results of the detections by the sensors 83 and 85, and controls the image former 221 to perform image formation.

The recording material S, with a toner image transferred on the first side by the image former 221, is further conveyed rearward along the first conveyance path 271 and enters the fuser 226. Then, the recording material S passes between the heating roller 243 and the pressing roller 344 of the fuser 226. Thus, the recording material S with the toner image transferred on the first side is further conveyed along the first conveyance path 271.

In simplex printing, the recording material S with the image formed on the first side is discharged onto the discharge tray 213.

In duplex printing, when the recording material S is further conveyed up to such a position that a trailing end portion (an upstream end portion) of the recording material S in the conveyance direction is pinched between the discharge rollers 253, the laser printer 201 (more specifically, the CPU 104) inverts the rotational direction of the discharge rollers 253. Thereby, the recording material S enters the second conveyance path 272 without being discharged onto the discharge tray 213.

The recording material S, having entered the second conveyance path 272, sequentially receives conveyance forces from the first inversion rollers 254 and the second inversion rollers 255, thereby proceeding along the second conveyance path 272. Then, the recording material S enters the first conveyance path 271 via the first junction J1. Thus, the recording material S is turned upside down and conveyed with a second side facing forward along the first conveyance path 271.

When the leading end of the recording material S reaches the second position P2, the surface characteristic sensor 83 detects surface characteristics of the second side of the recording material S. At this time, the basis weight sensor 85 does not detect the basis weight of the recording material S. After having finished detecting the surface characteristics of the second side by the surface characteristic sensor 83, the laser printer 201 sets image forming conditions in accordance with the detected surface characteristics of the second side and the basis weight of the recording material S detected when the recording material S passed through the third position P3 for the first time (i.e., during the first passage).

Afterward, the image former 221 performs image formation on the second side of the recording material S in the same manner as image formation on the first side. After having finished image formation on the second side, the laser printer 201 discharges onto the discharge tray 213 the recording material S with the images formed on both the first and second sides, without inverting the rotational direction of the discharge rollers 253.

<Operations and Advantageous Effects>

In the same manner as the laser printer 1, in duplex printing, when a recording material S passes through the second position P2 and the third position P3 for the first time (i.e., during the first passage), the laser printer 201 detects a basis weight of the recording material S by the basis weight sensor 85 and detects surface characteristics of a first side of the recording material S by the surface characteristic sensor 83. When the recording material S passes through the second position P2 and the third position P3 for the second time (i.e., during the second passage), the laser printer 201 detects surface characteristics of a second side of the recording material S by the surface characteristic sensor 83 but does not detect the basis weight of the recording material S by the basis weight sensor 85.

Therefore, it is possible to make shorter a period of time required for duplex printing for a single recording material S than when detection of surface characteristics of a specific side of the recording material S by the surface characteristic sensor 83 and detection of a basis weight of the recording material S by the basis weight sensor 85 are both performed each time the recording material S passes through the second position P2 and the third position P3 during the duplex printing. Further, since the surface characteristics of each side of the recording material S and the basis weight of the recording material S are detected, it is possible to identify a type of the recording material S.

Thus, it is possible to identify the type of the recording material S and improve throughput for duplex printing for the recording material S.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

<Modifications>

In the aforementioned first illustrative embodiment, the first position P1 is defined as a position between the photoconductive drum 42 and the transfer roller 44. Nonetheless, for instance, in a tandem type color laser printer, the first position P1 may be defined as a position between the most upstream one of photoconductive drums and a transfer belt.

In the aforementioned illustrative embodiments, the second position P2 where the surface characteristic sensor 83 is disposed and the third position P3 where the basis weight sensor 85 is disposed are coincident with each other in the front-to-rear direction but different from each other in the left-to-right direction. However, the second position P2 and the third position P3 may be different from each other in the front-to-rear direction.

In the aforementioned illustrative embodiments, in image formation on the first side of the recording material S, the basis weight sensor 85 detects the basis weight of the recording material S, and thereafter, the surface characteristic sensor 83 detects the surface characteristics of the first side of the recording material S. Nonetheless, for instance, the basis weight sensor 85 may detect the basis weight of the recording material S after the surface characteristic sensor 83 has detected the surface characteristics of the first side of the recording material S. Further, in the aforementioned first illustrative embodiment, the surface characteristic sensor 83 begins to detect the surface characteristics of a specific side of the recording material S at a point of time when the leading end of the recording material S in the conveyance direction reaches the registration rollers 61. However, the surface characteristic sensor 83 may start detecting the surface characteristics of the specific side of the recording material S before the leading end of the recording material S in the conveyance direction reaches the registration rollers 61. Further, in image formation on the first side of the recording material S, the basis weight sensor 85 may start detecting the basis weight of the recording material S at the same time when the surface characteristic sensor 83 starts detecting the surface characteristics of the first side of the recording material S.

In the aforementioned illustrative embodiments, the image forming conditions for the second side of the recording material S are set based on the surface characteristics of the second side and the basis weight of the recording material S detected when the recording material S passed through the third position P3 for the first time (i.e., during the first passage). Nonetheless, for instance, the basis weight of the recording material S may be detected when the recording material S passed through the third position P3 for the second time (i.e., during the second passage). In this case, the basis weight detected during the second passage may not necessarily be used to set the image forming conditions for the second side of the recording material S. Namely, even in this case, the image forming conditions for the second side of the recording material S may be set based on the surface characteristics of the second side and the basis weight detected during the first passage, without using the basis weight detected during the second passage.

In the aforementioned illustrative embodiments, the laser printer 1 and the laser printer 201 have been exemplified as image forming apparatuses according to aspects of the present disclosure. Nonetheless, aspects of the present disclosure may be applied to an inkjet printer configured to form an image on a recording material S in an inkjet method.

Associations between elements exemplified in the aforementioned illustrative embodiments and elements according to aspects of the present disclosure will be exemplified below. The laser printer 1 may be an example of an "image forming apparatus" according to aspects of the present disclosure. The first conveyance path 71 may be an example of a "first conveyance guide" according to aspects of the present disclosure. The second conveyance path 72 may be an example of a "second conveyance guide" according to aspects of the present disclosure. The diverging point D1 may be an example of a "bifurcation" according to aspects of the present disclosure. The junction J1 may be an example of a "junction" according to aspects of the present disclosure. The image former 41 may be an example of an "image former" according to aspects of the present disclosure. The surface characteristic sensor 83 may be an example of a "first sensor" according to aspects of the present disclosure. The basis weight sensor 85 may be an example of a "second sensor" according to aspects of the present disclosure. The CPU 104 may be included in a "controller" according to aspects of the present disclosure. Further, the ROM 102 storing the programs 102A may be included in the "controller" according to aspects of the present disclosure. The display 107 may be an example of an "information outputter" according to aspects of the present disclosure.

What is claimed is:

1. An image forming apparatus having a duplex printing function to perform image formation on both sides of a sheet by inverting the sheet, the image forming apparatus comprising:

a first conveyance guide configured to guide the sheet therealong;

an image former disposed in a first position along the first conveyance guide, the image former being configured to perform image formation on each side of the sheet being conveyed along the first conveyance guide, under a specific image forming condition for each side of the sheet;

a second conveyance guide diverging from the first conveyance guide at a bifurcation and joining the first conveyance guide at a junction, the bifurcation being positioned downstream of the first position in the conveyance direction on the first conveyance guide, the junction being positioned upstream of the first position in the conveyance direction on the first conveyance guide;

a first sensor disposed in a second position between the junction and the first position along the first conveyance guide, the first sensor being configured to detect surface characteristics of the sheet;

a second sensor disposed in a third position between the junction and the first position along the first conveyance guide, the second sensor being configured to detect a basis weight of the sheet; and a controller configured to judge whether to perform image formation on a single side or both the sides of the sheet, and when judging to perform image formation on both the sides of the sheet, perform a duplex printing process comprising:

when the sheet passes through the second position and the third position while being conveyed for image formation on a first side of the sheet, detecting, by the first sensor, a surface characteristic of the first side of the sheet, and detecting the basis weight of the sheet by the second sensor;

determining an image forming condition for the first side of the sheet, based on the surface characteristic of the first side and the basis weight of the sheet;

controlling the image former to perform image formation on the first side of the sheet under the image forming condition determined for the first side;

when the sheet, after inverted, again passes through the second position and the third position while being conveyed for image formation on a second side of the sheet, detecting, by the first sensor, a surface characteristic of the second side of the sheet, the second side being an opposite surface of the first side;

determining an image forming condition for the second side of the sheet, based on the surface characteristic of the second side and the basis weight detected by the second sensor when the sheet passed through the second position and the third position for image formation on the first side of the sheet; and controlling the image former to perform image formation on the second side of the sheet under the image forming condition determined for the second side.

2. The image forming apparatus according to claim 1, wherein the duplex printing process further comprises:

determining whether the second side of the sheet is suitable for image formation, based on the surface characteristic of the second side;

in response to determining that the second side of the sheet is suitable for image formation, continuing conveying the sheet; and in response to determining that the second side of the sheet is not suitable for image formation, stopping conveying the sheet.

3. The image forming apparatus according to claim 2, further comprising an information outputter, wherein the duplex printing process further comprises:

in response to determining that the second side of the sheet is not suitable for image formation, controlling the information outputter to output a notification that the second side of the sheet is not suitable for image formation.

4. The image forming apparatus according to claim 3, wherein the duplex printing process further comprises:

after the information outputter outputs the notification that the second side of the sheet is not suitable for image formation, controlling the information outputter to output an inquiry about whether to perform image formation on the second side of the sheet.

5. The image forming apparatus according to claim 1, wherein the duplex printing process further comprises:

determining whether the second side of the sheet is a printable surface, based on the surface characteristic of the second side; and in response to determining that the second side of the sheet is a printable surface, continuing conveying the sheet.

6. The image forming apparatus according to claim 5, further comprising an information outputter, wherein the duplex printing process further comprises:

in response to determining that the second side of the sheet is not a printable surface, controlling the information outputter to output a notification that the second side of the sheet is not a printable surface.

7. The image forming apparatus according to claim 6, wherein the duplex printing process further comprises:

after the information outputter outputs the notification that the second side of the sheet is not a printable surface, conveying the sheet to a downstream end of the first conveyance guide in the conveyance direction.

8. The image forming apparatus according to claim 1, wherein the duplex printing process further comprises:

determining whether the surface characteristic of the second side is identical to the surface characteristic of the first side, based on the surface characteristic of the first side and the surface characteristic of the second side; and in response to determining that the surface characteristic of the second side is identical to the surface characteristic of the first side, continuing conveying the sheet.

9. The image forming apparatus according to claim 8, further comprising an information outputter, wherein the duplex printing process further comprises:

in response to determining that the surface characteristic of the second side is different from the surface characteristic of the first side, controlling the information outputter to output a notification that the surface characteristic of the second side is different from the surface characteristic of the first side.

10. The image forming apparatus according to claim 9, wherein the duplex printing process further comprises:

after the information outputter outputs the notification that the surface characteristic of the second side is different from the surface characteristic of the first side, conveying the sheet to a downstream end of the first conveyance guide in the conveyance direction.

11. The image forming apparatus according to claim 1, wherein the controller comprises:

a processor; and a memory storing processor-executable instructions configured to, when executed by the processor, cause the processor to perform the duplex printing process.

12. A method implementable on a processor coupled with an image forming apparatus, the image forming apparatus having a duplex printing function to perform image formation on both sides of a sheet by inverting the sheet, the image forming apparatus comprising:

a first conveyance guide configured to guide the sheet therealong;

an image former disposed in a first position along the first conveyance guide, the image former being configured to perform image formation on each side of the sheet being conveyed along the first conveyance guide, under a specific image forming condition for each side of the sheet;

a second conveyance guide diverging from the first conveyance guide at a bifurcation and joining the first conveyance guide at a junction, the bifurcation being positioned downstream of the first position in the conveyance direction on the first conveyance guide, the junction being positioned upstream of the first position in the conveyance direction on the first conveyance guide;

a first sensor disposed in a second position between the junction and the first position along the first conveyance guide, the first sensor being configured to detect surface characteristics of the sheet; and a second sensor disposed in a third position between the junction and the first position along the first conveyance guide, the second sensor being configured to detect a basis weight of the sheet, the method comprising:

judging whether to perform image formation on a single side or both the sides of the sheet; and when judging to perform image formation on both the sides of the sheet, performing a duplex printing process comprising:

when the sheet passes through the second position and the third position while being conveyed for image formation on a first side of the sheet, detecting, by the first sensor, a surface characteristic of the first side of the sheet, and detecting the basis weight of the sheet by the second sensor;

determining an image forming condition for the first side of the sheet, based on the surface characteristic of the first side and the basis weight of the sheet;

controlling the image former to perform image formation on the first side of the sheet under the image forming condition determined for the first side;

when the sheet, after inverted, again passes through the second position and the third position while being conveyed for image formation on a second side of the sheet, detecting, by the first sensor, a surface characteristic of the second side of the sheet, the second side being an opposite surface of the first side;

determining an image forming condition for the second side of the sheet, based on the surface characteristic of the second side and the basis weight detected by the second sensor when the sheet passed through the second position and the third position for image formation on the first side of the sheet; and controlling the image former to perform image formation on the second side of the sheet under the image forming condition determined for the second side.

13. A non-transitory computer-readable medium storing computer-readable instructions that are executable by a processor coupled with an image forming apparatus, the image forming apparatus having a duplex printing function to perform image formation on both sides of a sheet by inverting the sheet, the image forming apparatus comprising:

a first conveyance guide configured to guide the sheet therealong;

an image former disposed in a first position along the first conveyance guide, the image former being configured to perform image formation on each side of the sheet being conveyed along the first conveyance guide, under a specific image forming condition for each side of the sheet;

a second conveyance guide diverging from the first conveyance guide at a bifurcation and joining the first conveyance guide at a junction, the bifurcation being positioned downstream of the first position in the conveyance direction on the first conveyance guide, the junction being positioned upstream of the first position in the conveyance direction on the first conveyance guide;

a first sensor disposed in a second position between the junction and the first position along the first conveyance guide, the first sensor being configured to detect surface characteristics of the sheet; and a second sensor disposed in a third position between the junction and the first position along the first conveyance guide, the second sensor being configured to detect a basis weight of the sheet, the instructions being configured to, when executed by the processor, cause the processor to:

judge whether to perform image formation on a single side or both the sides of the sheet; and when judging to perform image formation on both the sides of the sheet, perform a duplex printing process comprising:

when the sheet passes through the second position and the third position while being conveyed for image formation on a first side of the sheet, detecting, by the first sensor, a surface characteristic of the first side of the sheet, and detecting the basis weight of the sheet by the second sensor;

determining an image forming condition for the first side of the sheet, based on the surface characteristic of the first side and the basis weight of the sheet;

controlling the image former to perform image formation on the first side of the sheet under the image forming condition determined for the first side;

when the sheet, after inverted, again passes through the second position and the third position while being conveyed for image formation on a second side of the sheet, detecting, by the first sensor, a surface characteristic of the second side of the sheet, the second side being an opposite surface of the first side;

determining an image forming condition for the second side of the sheet, based on the surface characteristic of the second side and the basis weight detected by the second sensor when the sheet passed through the second position and the third position for image formation on the first side of the sheet; and controlling the image former to perform image formation on the second side of the sheet under the image forming condition determined for the second side.

* * * * *